US008674910B2

(12) United States Patent
Asano

(10) Patent No.: US 8,674,910 B2
(45) Date of Patent: Mar. 18, 2014

(54) DISPLAY PANEL DRIVING METHOD, DISPLAY APPARATUS, DISPLAY PANEL DRIVING APPARATUS AND ELECTRONIC APPARATUS

(75) Inventor: Mitsuru Asano, Kanagawa (JP)

(73) Assignee: Sony Corporation, Tokyo (JP)

( * ) Notice: Subject to any disclaimer, the term of this patent is extended or adjusted under 35 U.S.C. 154(b) by 1189 days.

(21) Appl. No.: 12/153,478

(22) Filed: May 20, 2008

(65) Prior Publication Data

US 2008/0303847 A1 Dec. 11, 2008

(30) Foreign Application Priority Data

Jun. 5, 2007 (JP) ..... 2007-148697
Jun. 5, 2007 (JP) ..... 2007-148698

(51) Int. Cl.
*G09G 3/30* (2006.01)

(52) U.S. Cl.
USPC ..... 345/77; 345/76

(58) Field of Classification Search
USPC ..... 345/76–83, 100–102, 204–215, 345/690–699; 315/169.1–169.4
See application file for complete search history.

(56) References Cited

U.S. PATENT DOCUMENTS

| | | | | |
|---|---|---|---|---|
| 6,661,180 | B2 * | 12/2003 | Koyama | 315/169.3 |
| 7,573,445 | B2 | 8/2009 | Machida | |
| 7,782,276 | B2 * | 8/2010 | Shin | 345/76 |
| 8,537,182 | B2 * | 9/2013 | Hasegawa et al. | 345/691 |
| 2006/0232717 | A1 * | 10/2006 | Kervec et al. | 348/761 |
| 2007/0079191 | A1 * | 4/2007 | Shin | 714/726 |
| 2009/0201286 | A1 * | 8/2009 | Hasegawa et al. | 345/214 |
| 2012/0169802 | A1 * | 7/2012 | Hasegawa et al. | 345/691 |

FOREIGN PATENT DOCUMENTS

| | | | |
|---|---|---|---|
| JP | 04-329591 | A | 11/1992 |
| JP | 11-231835 | A | 8/1999 |
| JP | 2002-514320 | A | 5/2002 |
| JP | 2004-093682 | A | 3/2004 |
| JP | 2004-510208 | A | 4/2004 |
| JP | 2004-191752 | A | 7/2004 |
| JP | 2004-191932 | A | 7/2004 |
| JP | 2005-027028 | | 1/2005 |
| JP | 2005-266751 | A | 9/2005 |
| JP | 2005-266752 | A | 9/2005 |
| JP | 2006-053236 | A | 2/2006 |

(Continued)

OTHER PUBLICATIONS

Japanese Office Action issued Mar. 6, 2012 for corresponding Japanese Application No. 2007-148697.

(Continued)

*Primary Examiner* — Alexander Eisen
*Assistant Examiner* — Patrick F Marinelli
(74) *Attorney, Agent, or Firm* — Rader, Fishman & Grauer PLLC

(57) ABSTRACT

In the present invention, there is provided a display panel driving method of the type wherein the total light emitting period length within a one-field period is controlled to variably control the peak luminance level of a display panel, including the step of: variably controlling, where the one-field period has N light emitting periods, N being equal to or greater than 2, the end timing of the ith light emitting period and the start timing of the i+1th light emitting period so as to satisfy the total light emitting period length within the one-field period, i being an odd number which satisfies $1 \le i \le N-1$ while i+1 satisfies $2 \le i+1 \le N$.

9 Claims, 39 Drawing Sheets

(56) References Cited

FOREIGN PATENT DOCUMENTS

| | | | |
|---|---|---|---|
| JP | 2006-126779 | A | 5/2006 |
| JP | 2006-215213 | | 8/2006 |
| JP | 2006-259573 | A | 9/2006 |
| JP | 2007-086727 | A | 4/2007 |
| JP | 2007-316163 | A | 12/2007 |
| JP | 2008-304492 | A | 12/2008 |
| WO | WO-02/27700 | A2 | 4/2002 |
| WO | WO-2004/057561 | A1 | 7/2004 |

OTHER PUBLICATIONS

Japanese Office Action issued Mar. 6, 2012 for corresponding Japanese Application No. 2007-148698.

* cited by examiner

DISPLAY PANEL DRIVING METHOD, DISPLAY APPARATUS, DISPLAY PANEL DRIVING APPARATUS AND ELECTRONIC APPARATUS

CROSS REFERENCES TO RELATED APPLICATIONS

The present invention contains subject matter related to Japanese Patent Application JP 2007-148697 filed in the Japan Patent Office on Jun. 5, 2007, and to Japanese Patent Application JP 2007-148698 filed in the Japan Patent Office on Jun. 5, 2007, the entire contents of which being incorporated herein by reference.

BACKGROUND OF THE INVENTION

1. Field of the Invention

This invention relates generally to a method for controlling the peak luminance level of a display panel, and more specifically to a display panel driving method, a display apparatus, a display panel driving apparatus and an electronic apparatus.

2. Description of the Related Art

In recent years, development of display apparatus of the self-luminous type wherein organic EL (Electro Luminescence) devices are arranged in a matrix has been and is advancing. A display panel which uses an organic EL device is simple and easy in reduction in weight and film thickness and besides is high in response speed, and therefore is superior in a moving picture display characteristic. A display panel which uses an organic EL device is hereinafter referred to also as organic EL panel.

Incidentally, as a driving method for an organic EL panel, a passive matrix driving method and an active matrix driving method are available. Recently, development of a display panel of the active matrix driving type wherein an active device in the form of a thin film transistor and a capacitor are disposed for each pixel circuit is being carried out energetically.

FIG. 1 shows an example of a configuration of an organic EL panel having a variation function of a light emitting period. Referring to FIG. 1, the organic EL panel 1 includes a pixel array section 3, a first scanning line driving section 5 for writing a signal voltage, a second scanning line driving section 7 for controlling the light emitting period, and a data line driving section 9. Pixel circuits 11 are arranged in M rows×N columns in the pixel array section 3. The values of M and N depend upon the display resolution.

It is to be noted that a scanning line VSCAN1 in FIG. 1 is a wiring line for providing a writing timing of a signal voltage. Meanwhile, another scanning line VSCAN2 is a wiring line for providing a start timing and an end timing of a light emitting period. Further, a signal line Vsig is a wiring line for providing a signal voltage corresponding to pixel data.

FIG. 2 shows an example of a configuration of a pixel circuit 11 having a variation function of the light emitting period. It is to be noted that various circuit configurations have been proposed for such pixel circuits. FIG. 2 shows a one of comparatively simple ones of such circuit configurations.

Referring to FIG. 2, the pixel circuit 11 shown includes a write control device T1, a current driving device T2, a light emitting period control device T3, a holding capacitor Cs and an organic EL device OLED.

In the pixel circuit 11 shown in FIG. 2, an N-channel thin film transistor is used for the write control device T1 and a P-channel thin film transistor is used for the current driving device T2 while an N-channel thin film transistor is used for the light emitting period control device T3.

Here, the operation state of the write control device T1 is controlled by the first scanning line VSCAN1 connected to the gate electrode of the write control device T1. When the write control device T1 is in an on state, a signal voltage corresponding to pixel data is written into the holding capacitor Cs through the signal line Vsig.

The signal voltage after being written is held in the holding capacitor Cs for a period of time of one field. The signal voltage held in the holding capacitor Cs corresponds to the gate-source voltage Vgs of the current driving device T2.

Accordingly, drain current Ids having a magnitude corresponding to the magnitude of the signal voltage held in the holding capacitor Cs flows to the current driving device T2. As the drain current Ids increases, the current flowing to the organic EL device OLED increases and the emitted light luminance increases.

It is to be noted, however, that supplying and stopping of the drain current Ids to the organic EL device OLED are controlled by the light emitting period control device T3. In particular, the organic EL device OLED emits light only within a period within which the light emitting period control device T3 is in an on state. The operation state of the light emitting period control device T3 is controlled by the second scanning line VSCAN2.

Also a pixel circuit having a circuit configuration shown in FIG. 3 is used for the pixel circuit 11 having a variation function of the light emitting period. Referring to FIG. 3, the pixel circuit 11 shown is generally formed such that the voltage of a power supply line to which the current driving device T2 is connected is variably controlled to control supplying and stopping of the drain current Ids to the organic EL device OLED. The pixel circuit 11 includes a write control device T1, a current driving device T2, a holding capacitor Cs and an organic EL device OLED.

In the pixel circuit 11 shown in FIG. 3, a power supply line to which the source electrode of the current driving device T2 is connected corresponds to the second scanning line VSCAN2. To the second scanning line VSCAN2, a power supply voltage VDD of a high potential or a power supply voltage VSS2 of a low potential lower than a further power supply voltage VDD is supplied. Within a period within which the power supply voltage VDD of the high potential is supplied, the organic EL device OLED emits light, but within another period within which the power supply voltage VSS2 of the low potential is supplied, the organic EL device OLED emits no light.

FIGS. 4 and 5 illustrate relationships between voltages applied to the first scanning line VSCAN1 and the second scanning line VSCAN2 and the driving state of the corresponding pixel. It is to be noted that FIG. 4 illustrates the relationship where the light emitting period is long, and FIG. 5 illustrates the relationship where the light emitting period is short.

Incidentally, FIGS. 4 and 5 illustrate the relationships between the applied voltage and the driving state corresponding to the pixel circuits 11 from the first to third rows of the pixel array section 3. In particular, a numerical value in parentheses represents a corresponding row position.

As seen in FIGS. 4 and 5, a period within which both of the first scanning line VSCAN1 and the second scanning line VSCAN2 have the L level corresponds to a no-light emitting period.

On the other hand, a period within which the first scanning line VSCAN1 has the H level and the second scanning line VSCAN2 has the L level corresponds to a writing period of the signal voltage.

Further, a period within which the first scanning line VSCAN1 has the L level and the second scanning line VSCAN2 has the H level corresponds to a light emitting period.

The reason why a variation function of the light emitting period is incorporated in the pixel circuit 11 in this manner is that such several advantages as described below are achieved.

One of the advantages is that, even if the amplitude of an input signal is not varied, the peak luminance level can be adjusted. FIG. 6 illustrates a relationship between the light emitting period length occupying in a one-field period and the peak luminance level.

As a result, where the input signal is a digital signal, it is possible to adjust the peak luminance level without reducing the gradation number of the signal. On the other hand, where the input signal is an analog signal, since the signal amplitude does not decrease, the noise immunity can be raised. In this manner, variation control of the light emitting period length is effective to implement a pixel circuit which provides high picture quality and can easily adjust the peak luminance.

Further, the variation control of the light emitting period length has an advantage that, where the pixel circuit is of the current writing type, the writing current value can be increased to reduce the writing time.

Furthermore, the variation control of the light emitting period length is advantageous in that it improves the picture quality of moving pictures. It is to be noted that, in FIGS. 7 to 9, the axis of abscissa indicates the position on the screen and the axis of ordinate indicates the elapsed time. All of FIGS. 7 to 9 illustrate a movement of a line of sight where an emission line moves within the screen.

FIG. 7 indicates a display characteristic of the hold type display wherein the light emitting period is given as 100% of a one-field period. A representative one of an display apparatus of the type just described is a liquid crystal display apparatus.

FIG. 8 illustrates a display characteristic of the impulse type display apparatus wherein the light emitting period is sufficiently short with respect to a one-field period. A representative one of a display apparatus of the type described is a CRT (Cathode Ray Tube) display apparatus.

FIG. 9 illustrates a display characteristic of the hold type display apparatus wherein the light emitting period is limited to 50% of a one-field period.

As can be recognized from comparison of FIGS. 7 to 9, where the light emitting period is 100% of a one-field period as seen in FIG. 7, a phenomenon that the display width looks wider upon movement of a bright spot, that is, a motion artifact, is likely to be perceived.

On the other hand, where the light emitting period is sufficiently shorter than a one-field period as seen in FIG. 8, the display width remains short also upon movement of a bright point. In other words, a motion artifact is not perceived.

Where the light emitting period is 50% of a one-field period as seen in FIG. 9, also upon movement of a bright point, increase of the display width can be suppressed, and motion artifact can be reduced as much.

Generally, it is known that, in the case of moving pictures wherein a one-field period is given by 60 Hz, if the light emitting period is set to 75% or more of a one-field period, then the moving picture characteristic is deteriorated significantly. Thus, it is estimated that preferably the light emitting period is suppressed to less than 50% of a one-field period.

FIGS. 10 and 11 illustrate examples of a driving timing of the second scanning line VSCAN2 where a one-field period includes a single light emitting period. In particular, FIG. 10 illustrates an example of a driving timing where the light emitting period within a one-field period is 50% while FIG. 11 illustrates another example of a driving timing where the light emitting period within a one-field period is 20%. In FIGS. 10 and 11, it is illustrated that the phase relationship makes one cycle with 20 lines.

It is to be noted that the light emitting period corresponding to the sth scanning line VSCAN2(*s*) can be given by an expression given below. However, it is assumed that a one-field period is given by m horizontal scanning periods, and writing operation into the sth scanning line VSCAN2(*s*) is carried out within the sth horizontal scanning period and light emission is carried out simultaneously. Further, the ratio of the light emitting period occupying in a one-field period T is represented by DUTY.

At this time, the light emitting period and the no-light emitting period are individually given by the following expressions:

Light Emitting Period:

$$[(s-1)/mJ\cdot T<t<\{[(s-1)/m]+\mathrm{DUTY}\}\cdot T$$

No-Light Emitting Period:

$$\{[(s-1)/m]+\mathrm{DUTY}\}\cdot T<t<\{[(s-1)/mJ+1\}\cdot T$$

where t satisfies a period given by the following expression:

$$[(s-1)/mJ\cdot T<t<\{[(s-1)/mJ+1\}\cdot T$$

Relating techniques are disclosed in JP-A-2002-514320, Japanese Patent Laid-Open No. 2005-027028 and Japanese Patent Laid-Open No. 2006-215213.

SUMMARY OF THE INVENTION

However, where a light emitting period and a no-light emitting period are provided in a one-field period, suppression of flickering becomes a new technical subject to be solved. Generally, in the case of moving pictures whose one-field period is given by 60 Hz, it is known that, if the light emitting period is set lower than 25% of a one-field period, then flickering is actualized, and it is considered desirable to set the light emitting period equal to or longer than 50% of a one-field period.

In particular, it is known that, in restriction to the light emitting period, two items of the picture quality of moving pictures and flickering have a tradeoff relationship, and the setting range of the light emitting period is restricted by the tradeoff relationship. However, the restriction to the setting range leads to restriction of the variation range of the peak luminance level.

Therefore, as a method of reducing flickering where the light emitting period is short, a method of dividing a light emitting period within a one-field period into a plurality of periods has been proposed.

FIGS. 12 and 13 illustrate relationships between the voltages applied to the first scanning line VSCAN1 and the second scanning line VSCAN2 and the driving state of a corresponding pixel. In particular, FIG. 12 illustrates a relationship where the light emitting period is long while FIG. 13 illustrates a relationship where the light emitting period is short.

Incidentally, FIGS. 12 and 13 illustrate relationships between the applied voltage and the driving state corresponding to the pixel circuits 11 in the first to third rows of the pixel array section 3. In particular, a numerical value in parentheses represents a corresponding row position.

FIGS. 14 and 15 illustrate examples of a driving timing of the second scanning line VSCAN2 where a one-field period includes two light emitting periods. In the existing driving methods illustrated in FIGS. 14 and 15, one field is divided into a former half period and a latter half period, and the light emitting period is varied for each of the half periods. In particular, within the former half period, the light emitting period length is varied with reference to a reference point which is 0% of the one-field period, and within the latter half period, the light emitting period is varied with reference to a reference point which is 50% of the one-field period.

Incidentally, FIG. 14 illustrates an example of a driving timing where the total light emitting period within a one-field period is 50%, and FIG. 15 illustrates another example of a driving method wherein the total light emitting period within a one-field period is 20%. Also FIGS. 14 and 15 present that the phase relationship makes one cycle with 20 lines.

Where a one-field period includes two light emitting periods, the light emitting period corresponding to the sth scanning line VSCAN2(*s*) can be given by an expression given below. It is to be noted, however, that a one-field period is given as m horizontal scanning periods, and writing operation into the sth scanning line VSCAN2(*s*) is carried out within the sth horizontal scanning period and emission of light is started simultaneously. Further, the ratio of the light emitting period occupying in the one-field period T is represented by DUTY.

At this time, the light emitting period and the no-light emitting period are individually given by the following expressions:

Light Emitting Period in Former Half Period:

$$[(s-1)/m]\cdot T<t<\{[(s-1)/m]+\mathrm{DUTY}/2\}\cdot T$$

No-Light Emitting Period in Former Half Period:

$$\{[(s-1)/m]+\mathrm{DUTY}/2\}\cdot T<t<\{[(s-1)/m]+\tfrac{1}{2}\}T$$

Light Emitting Period in Latter Half Period:

$$[(s-1)/m+\tfrac{1}{2}]T<t<\{[(s-1)/m]+(1+\mathrm{DUTY})/2\}\cdot T$$

No-Light Emitting Period in Latter Half Period:

$$\{[(s-1)/m]+(1+\mathrm{DUTY})/2\}\cdot T<t<\{[(s-1)/m]+1\}\cdot T$$

where t satisfies a period given by the following expression:

$$[(s-1)/m]\cdot T<t<\{[(s-1)/m]+1\}\cdot T$$

However, in the driving method wherein a one-field period is divided into a former half period and a latter half period, where the total light emitting period is 50% of a one-field period, light emission of 25%→no-light emission of 25%→light emission of 25%→no-light emission of 25% occurs repetitively.

According to this form of light emission, a movement of a line of sight same as that where the light emitting period is 75% of a one-field period occurs.

In other words, in the driving method wherein a one-field period is simply divided into a former half period and a latter half period, while flickering can be reduced, there is a technical subject to be solved in that motion artifact occurs and deteriorates the picture quality of moving pictures.

Therefore, it is demanded to provide a driving technique for a display panel wherein the peak luminance level can be adjusted over a wide range while suppression of both of appearance of motion artifact caused by increase of the ratio of the total light emitting period length occupying in a one-field period and appearance of flickering caused by decrease of the ratio of the light emitting period can be achieved simultaneously.

An embodiment according to the present invention proposes a method of and an apparatus for variably controlling, where the one-field period has N light emitting periods defined therein, N being equal to or greater than 2, the end timing of the ith light emitting period and the start timing of the i+1th light emitting period so as to satisfy the total light emitting period length within the one-field period, i being an odd number which satisfies $1\le i\le N-1$ while i+1 satisfies $2\le i+1\le N$.

In the method and apparatus, the end timing of an odd-numbered light emitting period and the start timing of an even-numbered light emitting period are varied to control the total light emitting period length. In other words, the total light emitting period length is controlled so as to narrow the gap (no-light emitting time) between a light emitting period and an adjacent light emitting period from the opposite directions.

By the driving technique, a driving method wherein the start timing of the first-time light emitting period and the end timing of the last-time light emitting period are fixed can be implemented. Accordingly, if the length from the start timing of the first-time light emitting period to the end timing of the last-timing light emitting period is set suitably, then it is possible to fix the movement width of the line of sight also upon display of moving images.

Also it is possible to vary the end timing of the last-time light emitting period in response to the total light emitting period length. However, also in this instance, since the controlling operation of the total light emitting period length is executed so as to narrow the gap (no-light emitting period) between adjacent ones of the light emitting periods from the opposite directions, increase of the movement width of the line of sight upon display of moving images can be suppressed.

As a result, by suitably setting the length from the start timing of the first-time light emitting period to the end timing of the last-time light emitting period, the peak luminance level can be adjusted over a wide range while appearance of flickering and motion artifact is suppressed.

BRIEF DESCRIPTION OF THE DRAWINGS

The above and other objects, features and advantages of the present invention will become apparent from the following description and the appended claims, taken in conjunction with the accompanying drawings in which like parts or elements denoted by like reference symbols.

DETAILED DESCRIPTION OF THE PREFERRED EMBODIMENTS

In the following, an organic EL panel of the active matrix driving type to which embodiments according to the present invention are applied is described.

It is to be noted that, to those matters which are not disclosed in the present specification and the accompanying drawings, techniques which are known in the technical field to which an embodiment according to the present invention belongs are applied.

A. Structure of the Organic EL Panel

Figure 1:
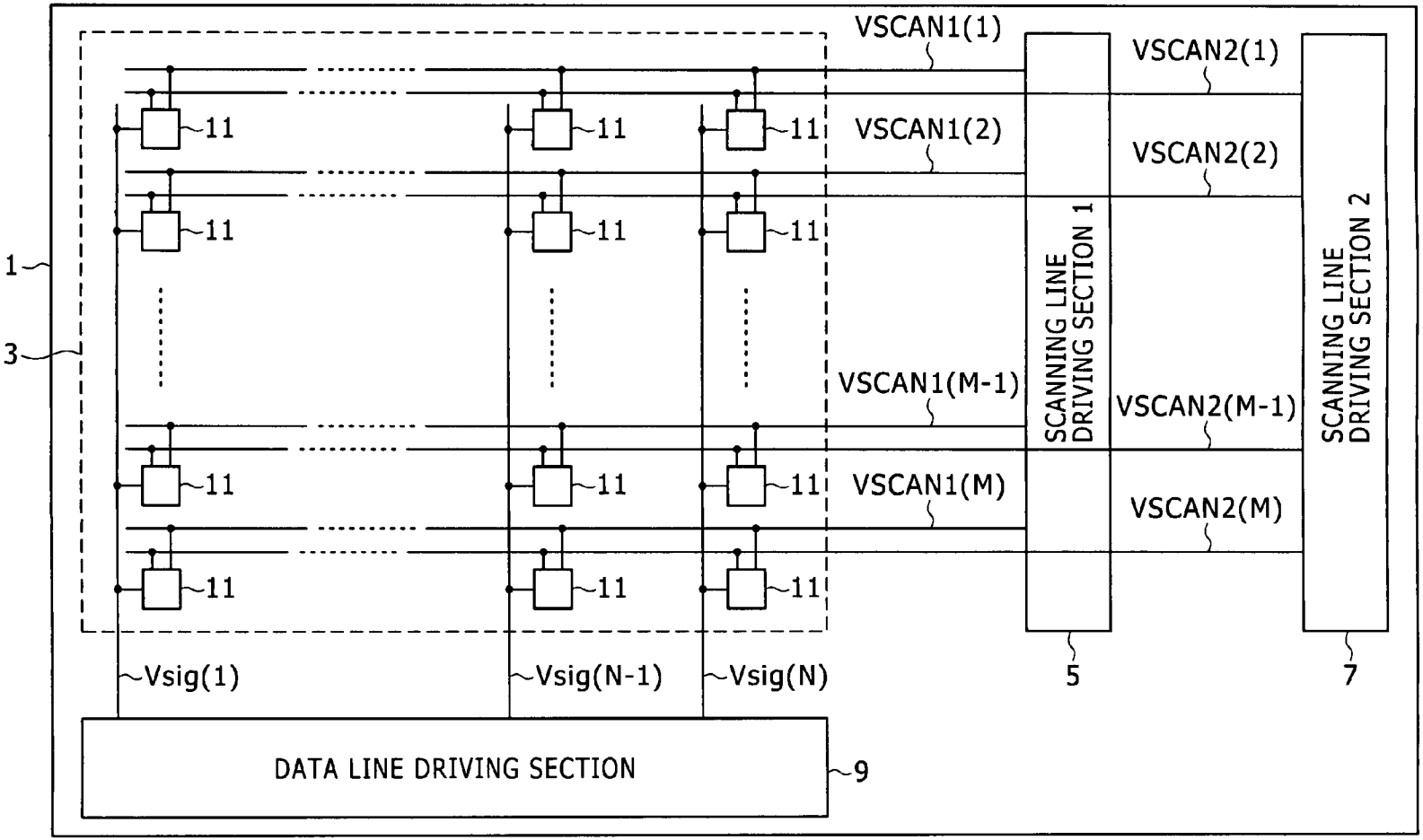
FIG. 1 (Related Art)
FIG. 1 is a circuit diagram showing an example of a general configuration of an organic EL panel in related art.
Figure 2:
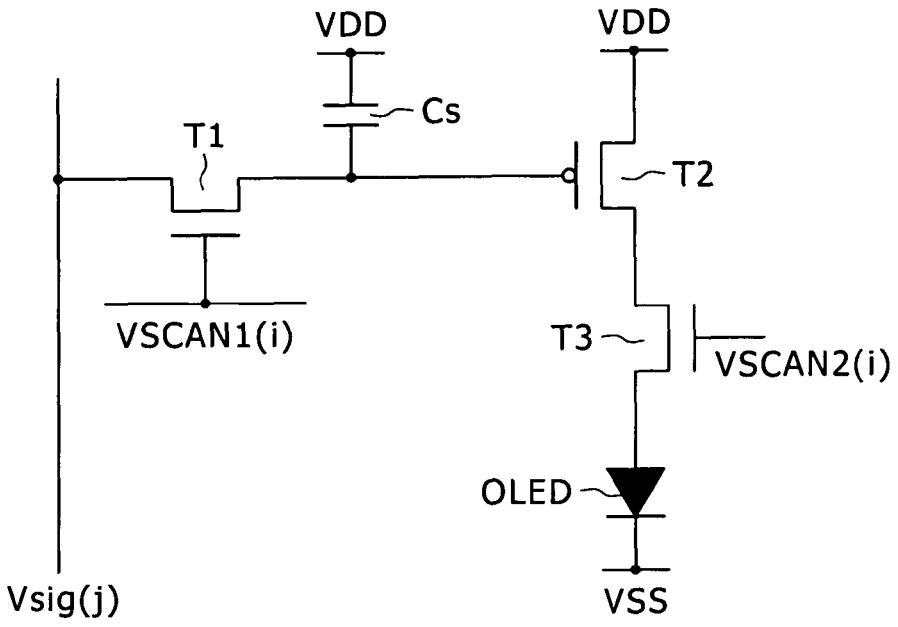
FIG. 2 (Related Art)
FIGS. 2 and 3 are circuit diagrams showing different examples of a pixel circuit of the active matrix driving type.
Figure 3:
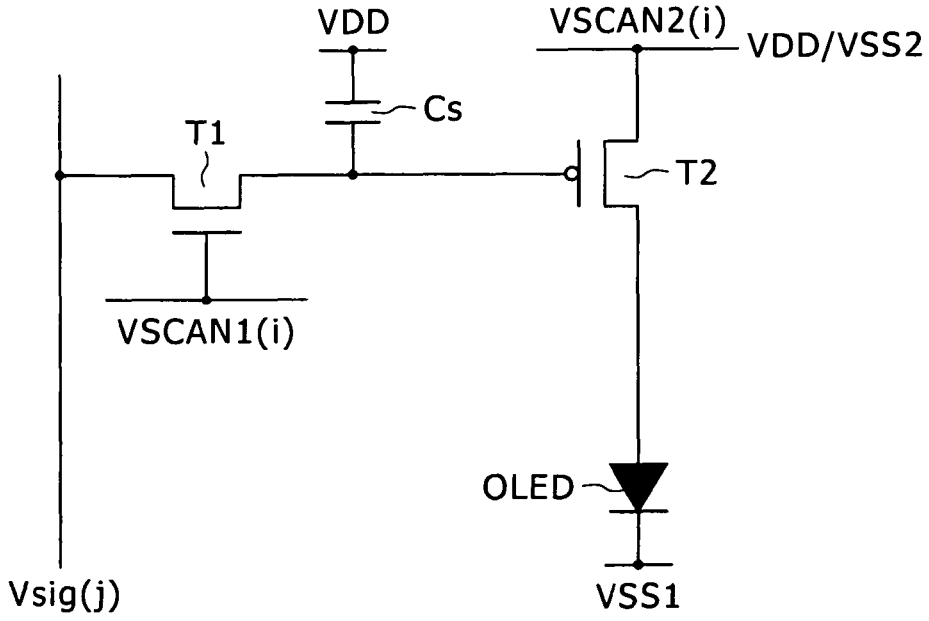
FIG. 3 (Related Art)
Figure 4:
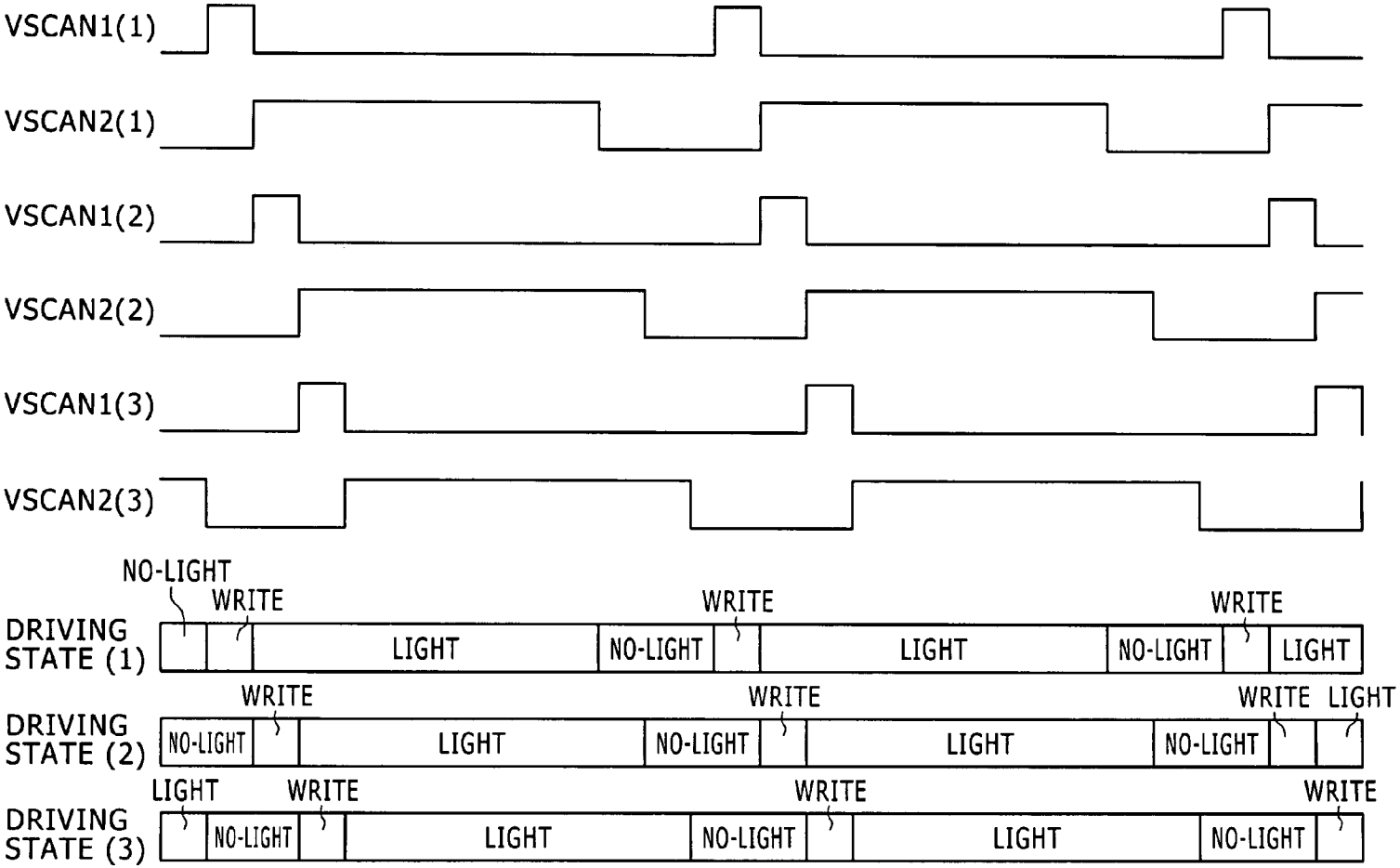
FIG. 4 (Related Art)
FIGS. 4 and 5 are timing charts illustrating different examples of driving operation of the organic EL panel in related art which includes one light emitting period.
Figure 5:
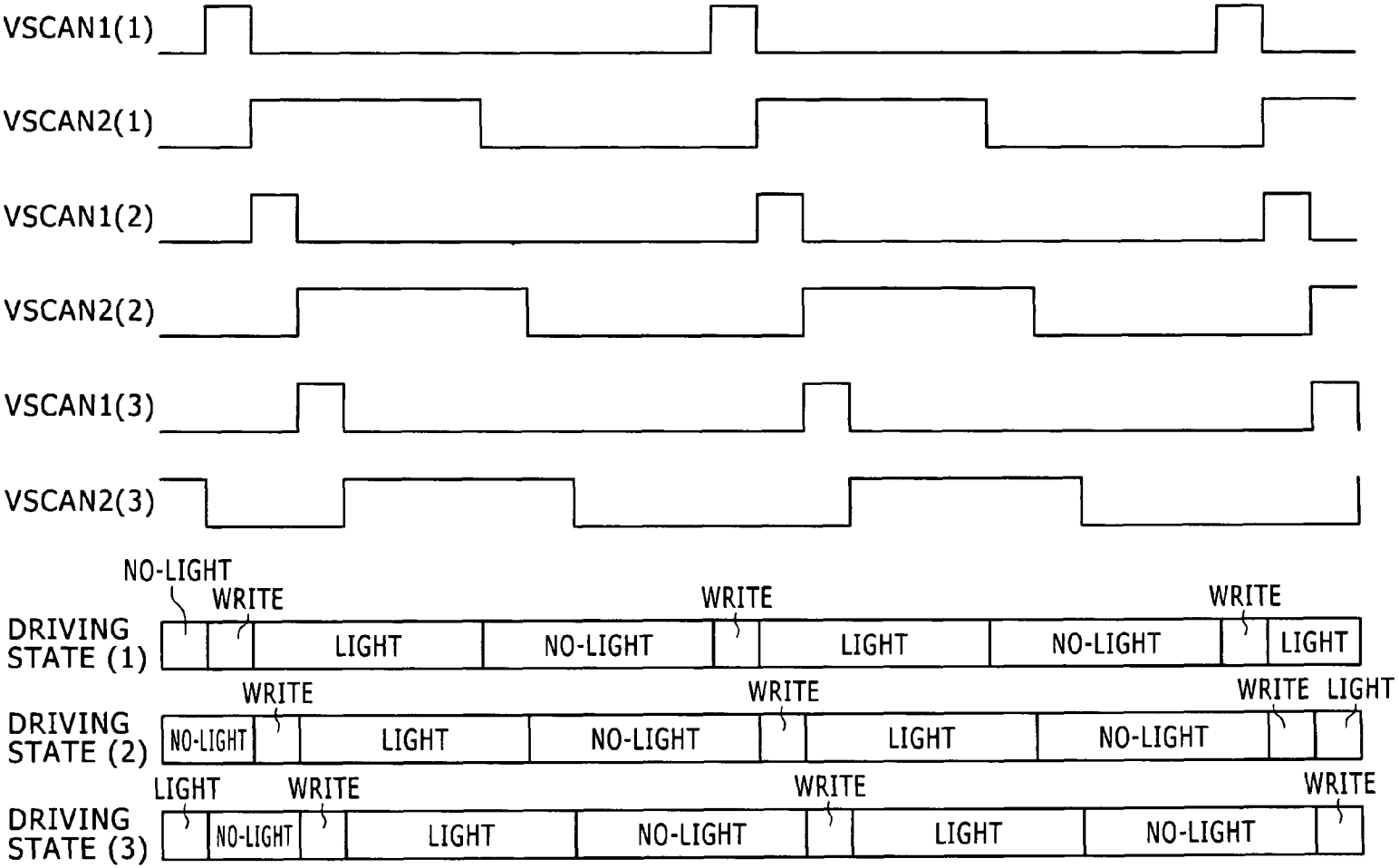
FIG. 5 (Related Art)
Figure 6:
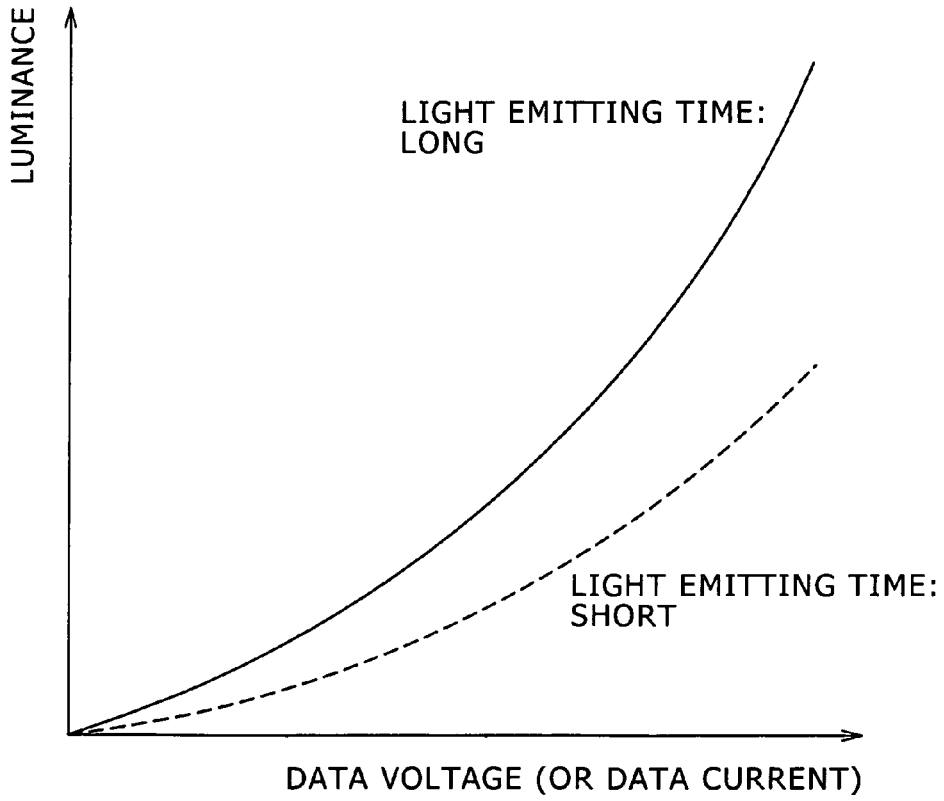
FIG. 6 (Related Art)
FIG. 6 is a diagram illustrating a relationship between a light emitting period length and a peak luminance level.
Figure 7:
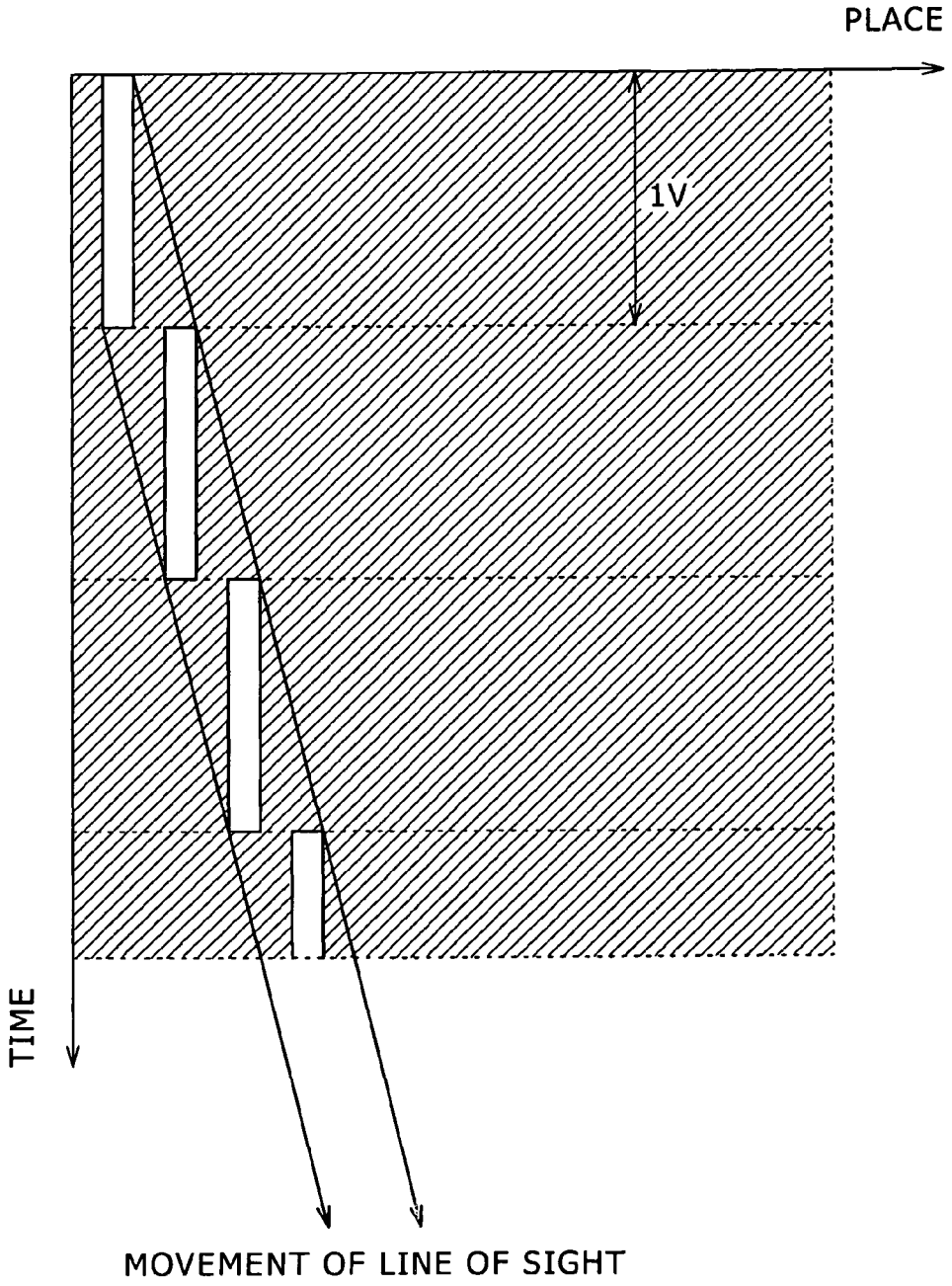
FIG. 7 (Related Art)
FIGS. 7 to 9 are diagrammatic views illustrating different relationships between the light emitting period length and the movement of the line of sight.
Figure 8:
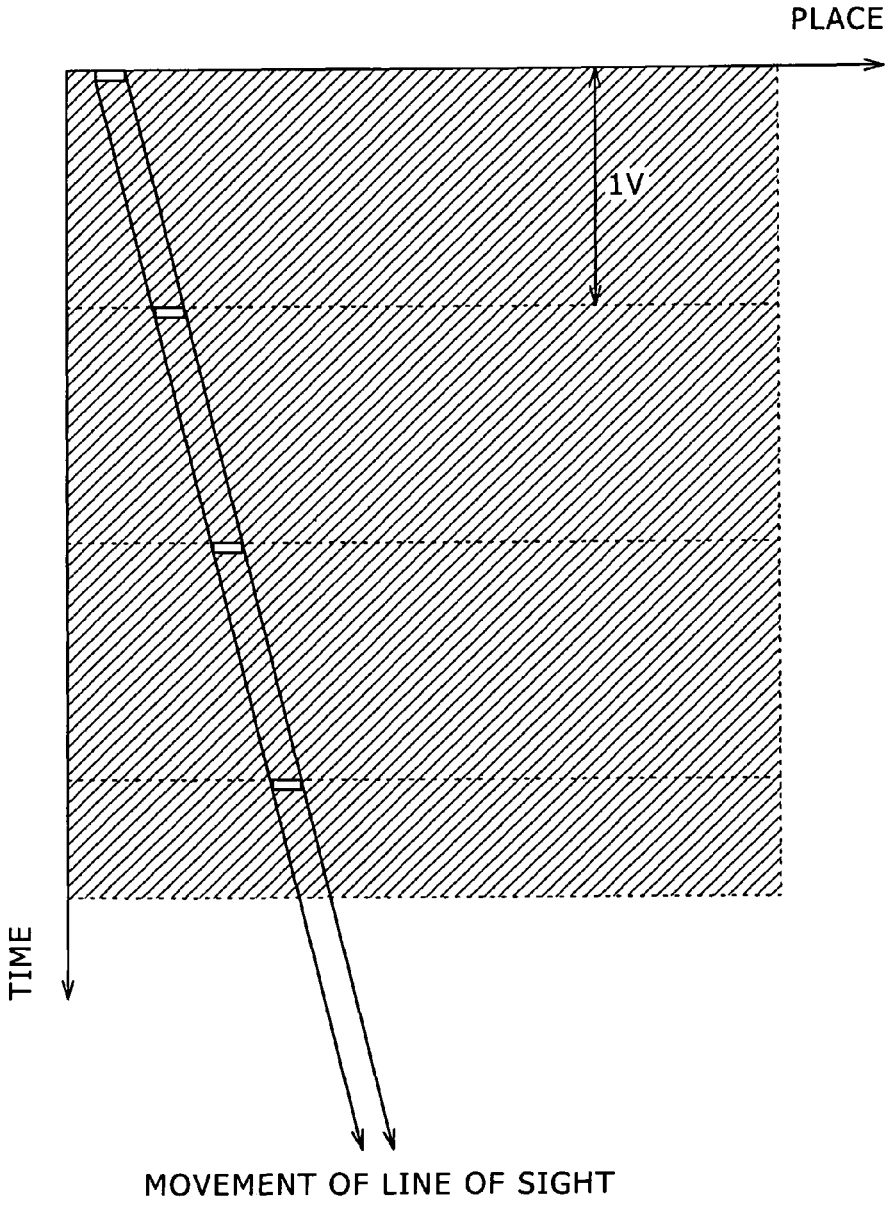
FIG. 8 (Related Art)
Figure 9:
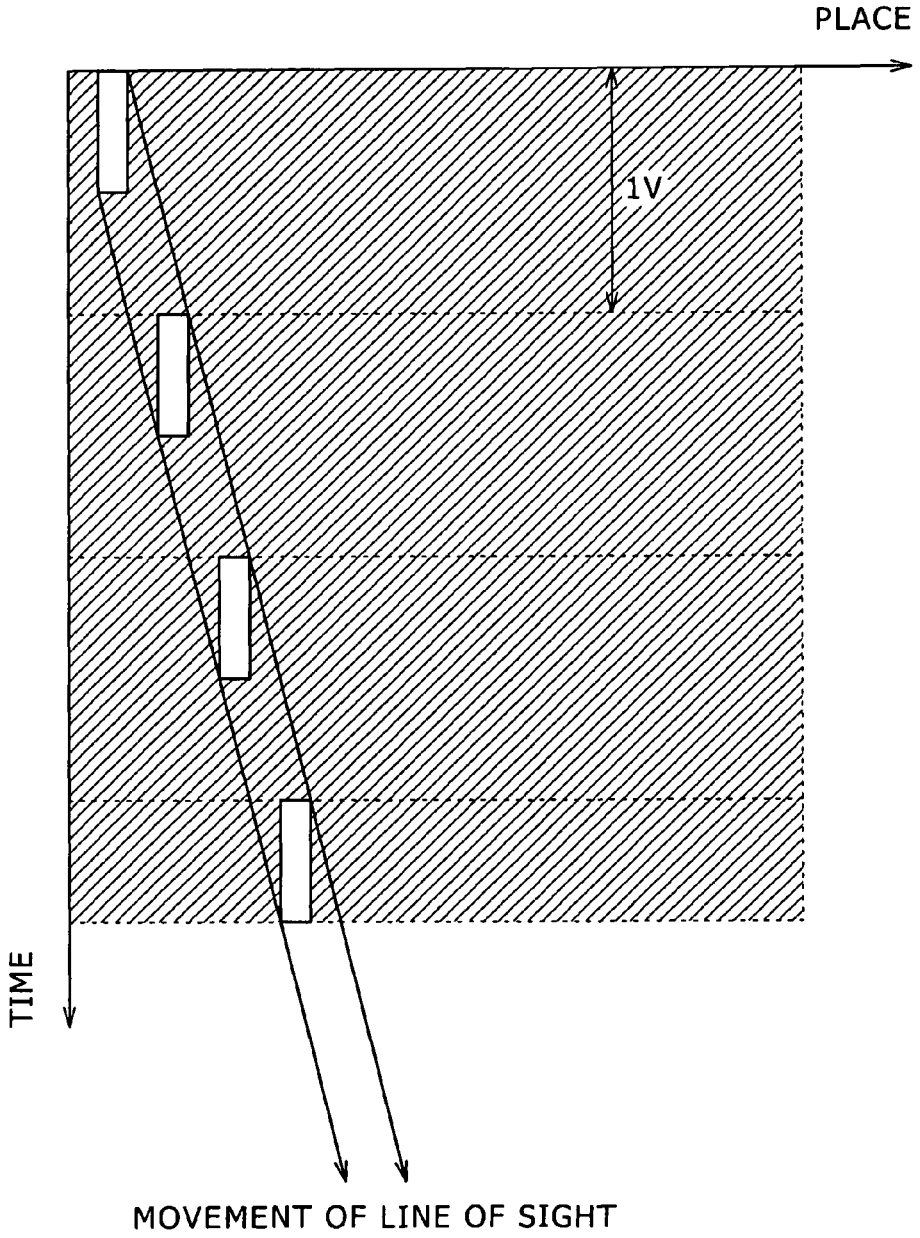
FIG. 9 (Related Art)
Figure 10:
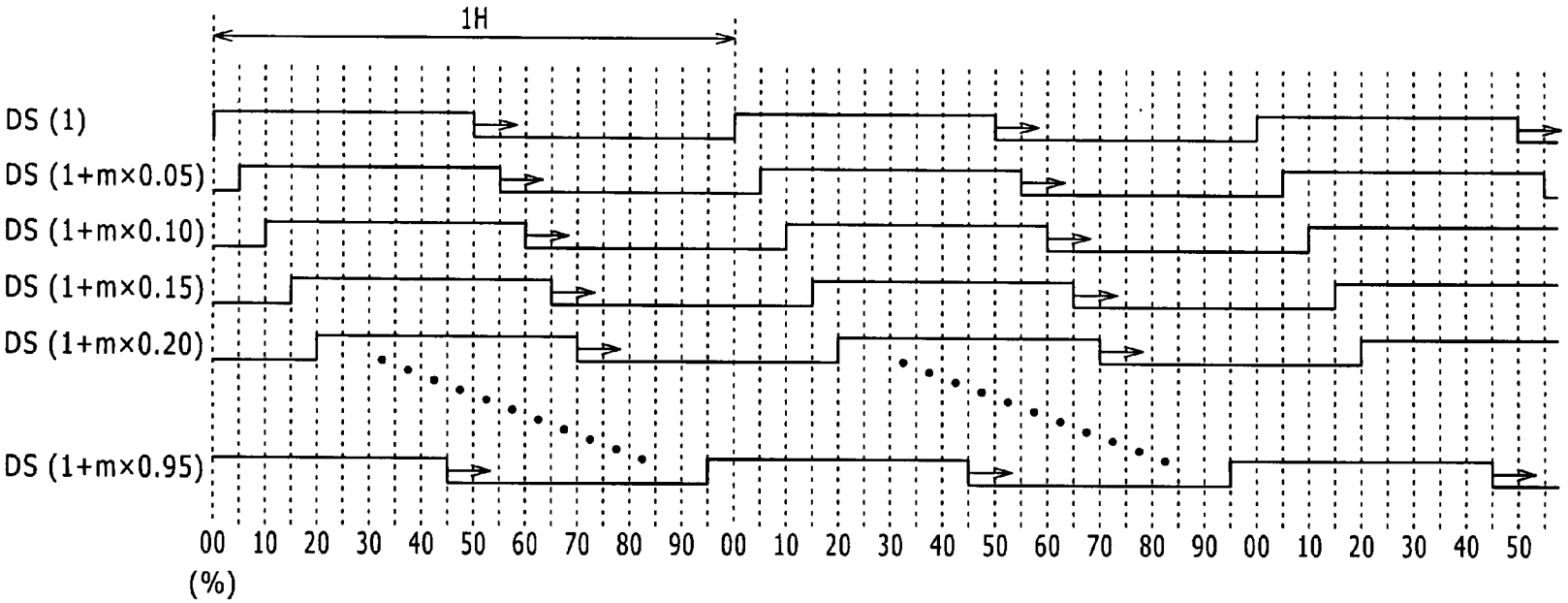
FIG.10 (Related Art)
FIGS. 10 and 11 are timing charts illustrating different examples of driving timings where the light emitting period lengths of 50% and 20% are provided by one light emitting period, respectively, in the organic EL panel in related art.
Figure 11:
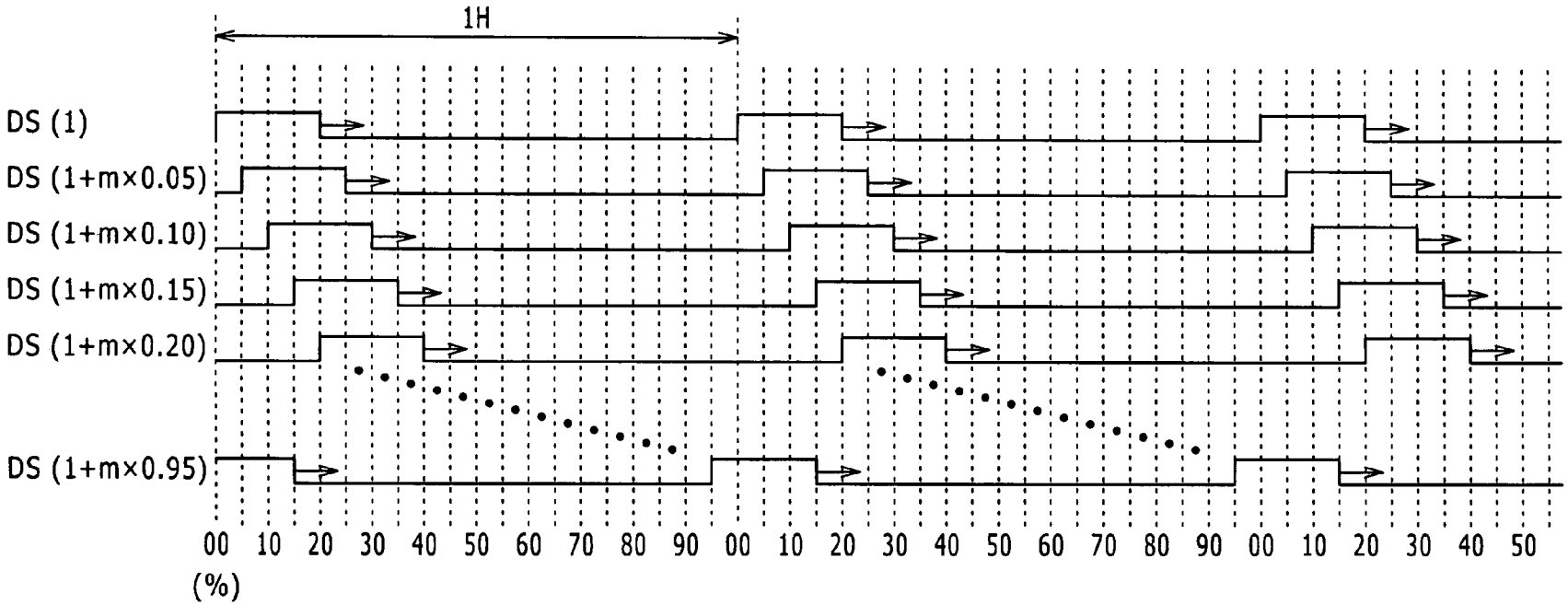
FIG.11 (Related Art)
Figure 12:
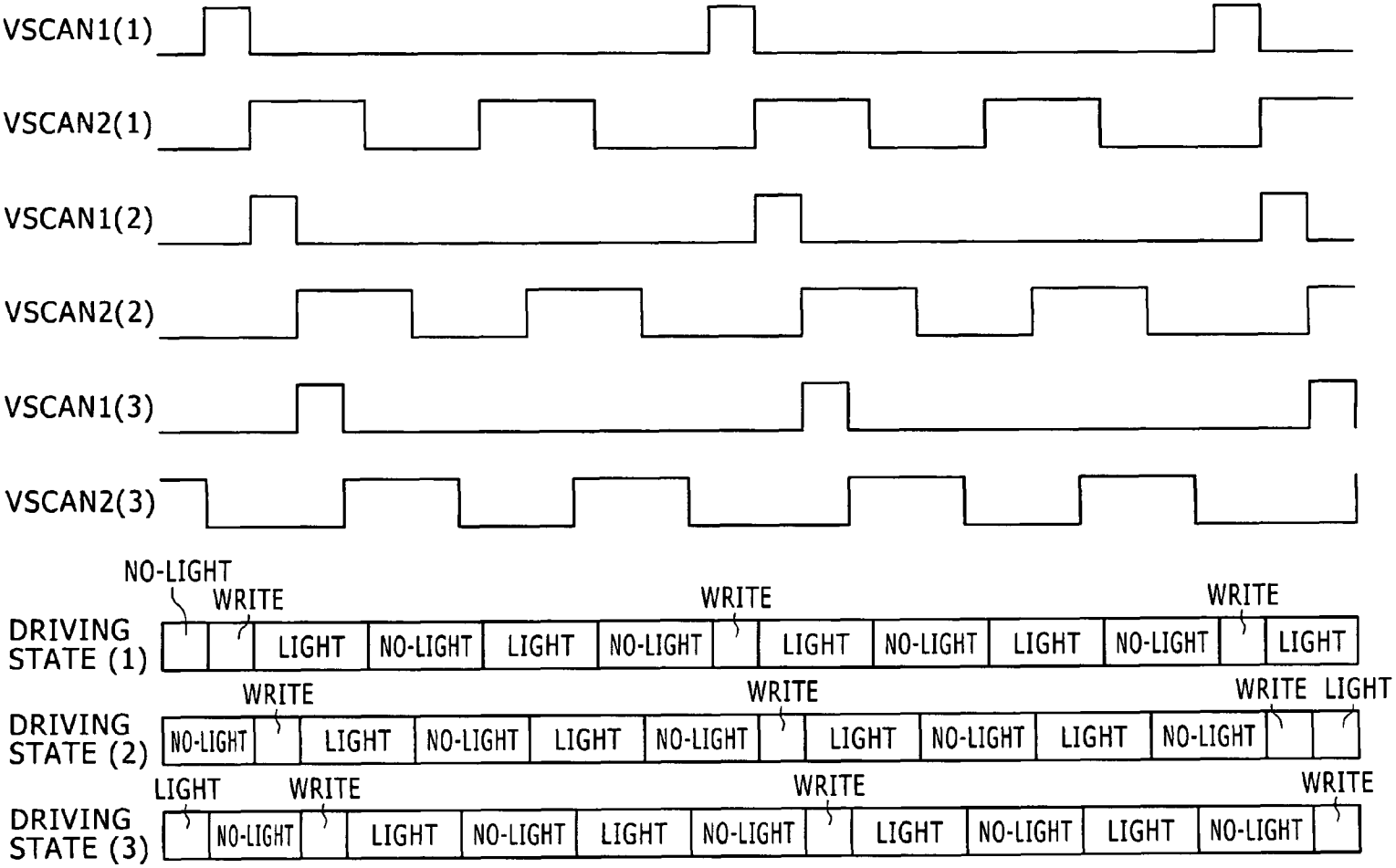
FIG.12 (Related Art)
FIG. 12 is a timing chart illustrating an example of driving operation of the organic EL panel in related art which includes two light emitting periods.
Figure 13:
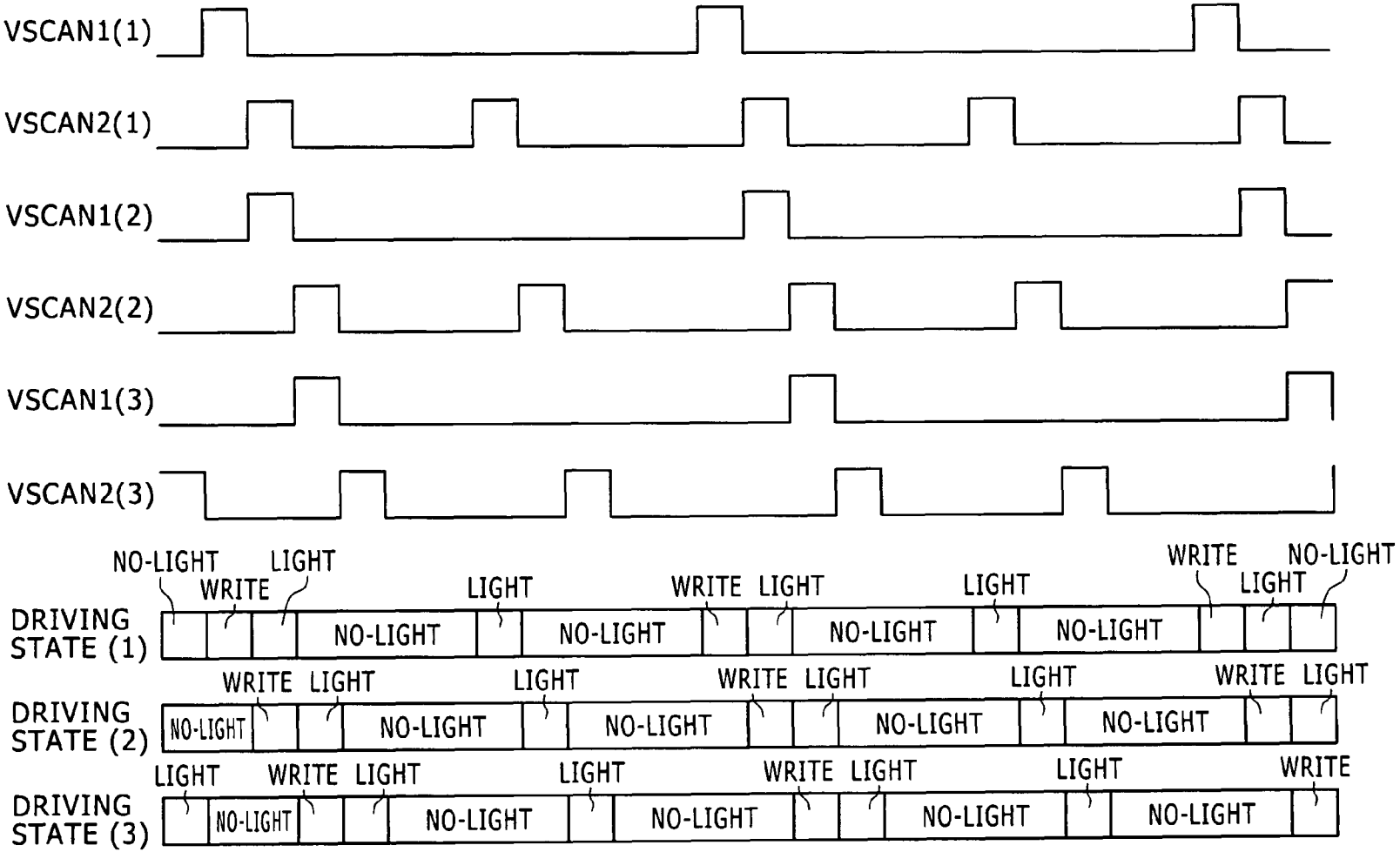
FIG.13 (Related Art)
FIG. 13 is a timing chart illustrating an example of driving operation of the organic EL panel in related art which includes one light emitting period.
Figure 14:
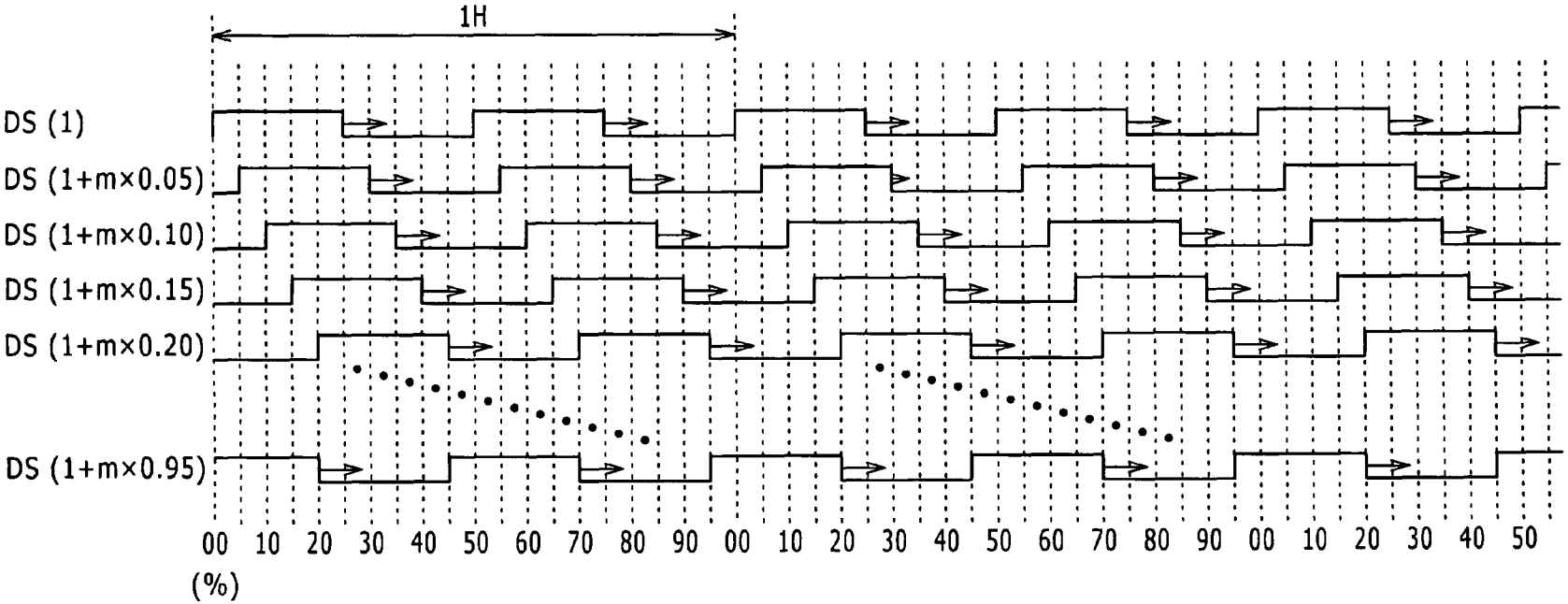
FIG. 14 (Related Art)
FIG. 14 is a timing chart illustrating an example of driving timings where the light emitting period length of 50% is provided by two light emitting periods in the organic EL panel in related art.
Figure 15:
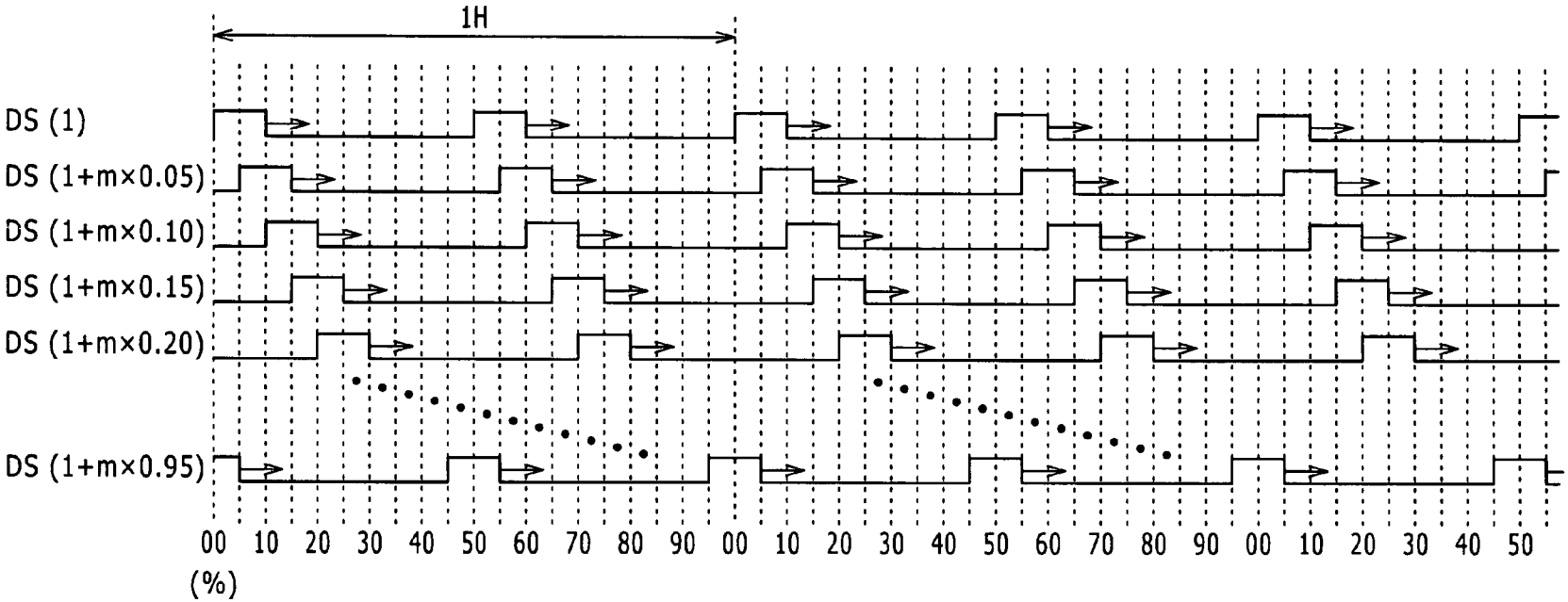
FIG.15 (Related Art)
FIG. 15 is a timing chart illustrating an example of driving timings where the light emitting period length of 20% is provided by one light emitting period in the organic EL panel in related art.
Figure 16:
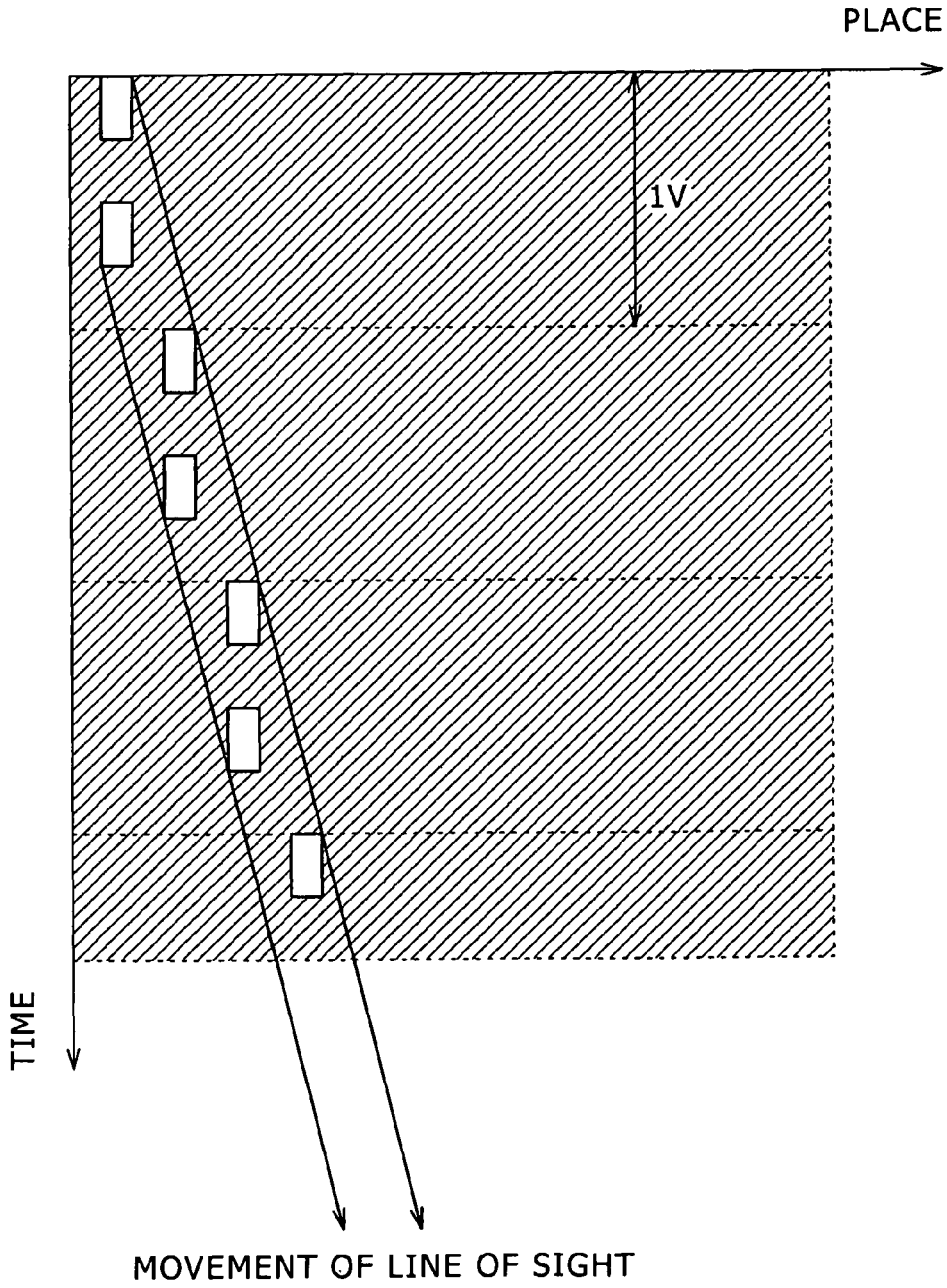
FIG.16 (Related Art)
FIG. 16 is a diagrammatic view illustrating a relationship between the light emitting period length and the movement of a line of sight in the EL panel in related art.
Figure 17:
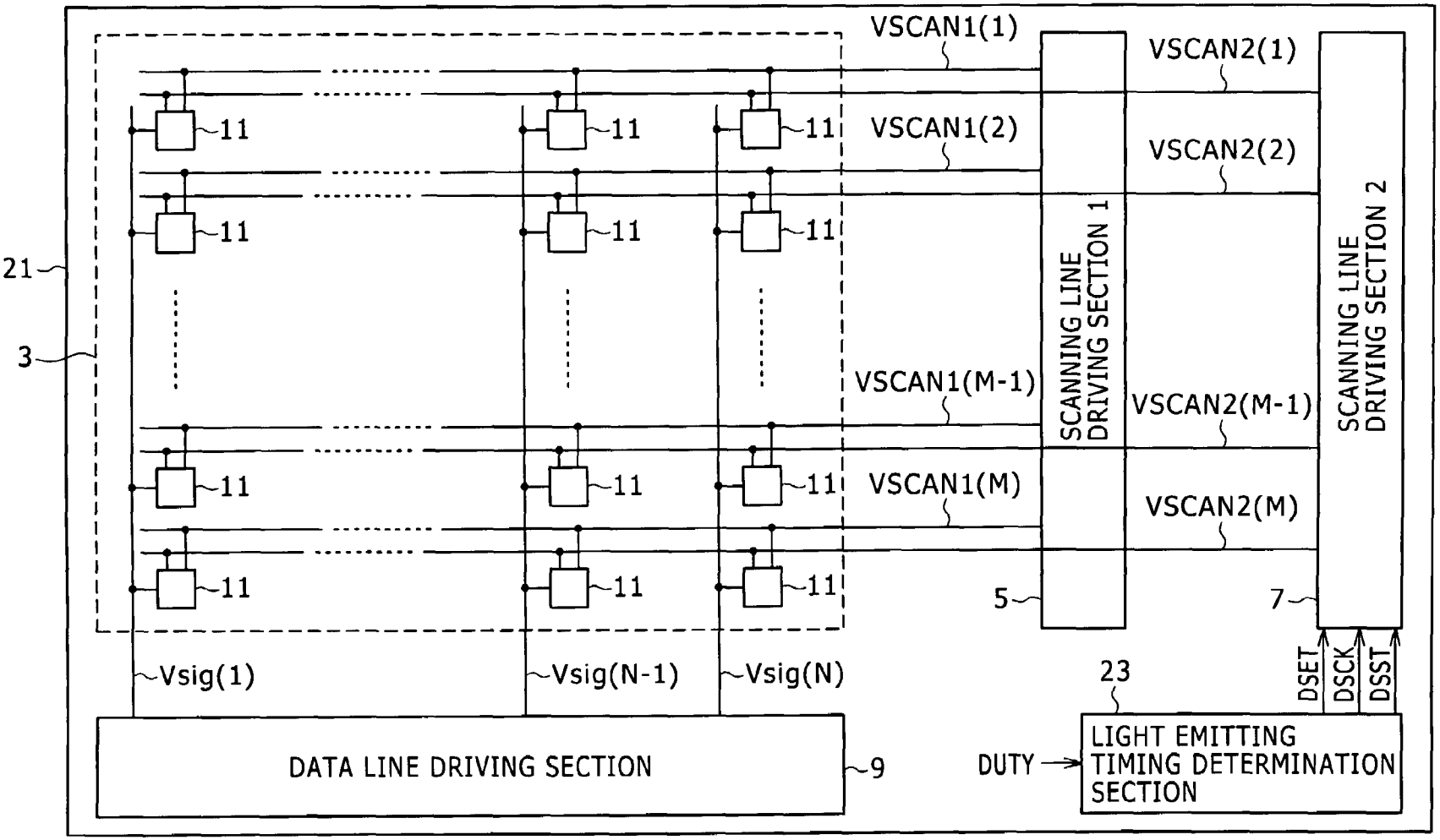
FIG. 17 is a circuit diagram showing an example of a general configuration of an organic EL panel to which an embodiment according to the present invention is applied.

FIG. 17 shows an example of a general configuration of an organic EL panel to which an embodiment according to the present invention is applied.

Referring to FIG. 17, the organic EL panel 21 includes a pixel array section 3, a first scanning line driving section 5 for writing a signal voltage, a second scanning line driving section 7 for controlling the light emitting period, a data line driving section 9, and a light emitting timing determination section 23. The pixel array section 3 includes pixel circuits 11 arranged in M rows×N columns. The values of M and N depend upon the display resolution.

The light emitting timing determination section 23 is a component unique to the organic EL panel 21. A ratio DUTY of a light emitting period occupying within a one-field period T is provided to the light emitting timing determination section 23. The light emitting timing determination section 23 determines an arrangement of light emitting periods so as to satisfy the ratio DUTY provided thereto. Here, the arrangement of the light emitting periods is determined for each second scanning line VSCAN2. The light emitting timing determination section 23 and the second scanning line driving section 7 correspond to a "display panel driving section".

Although a particular determination method of light emitting periods is hereinafter described, the light emitting timing determination section 23 determines start timings and end timings of light emitting periods such that a period between two adjacent ones of light emitting periods, that is, a no-light emitting period, is narrowed from the opposite directions.

It is to be noted that, in order to reduce flickering and motion artifact to improve the picture quality, it is desirable to determine timings such that the period length from a start timing of the first-time light emitting period to an end timing of the last-time light emitting period becomes equal to or longer than 25% of a one-field period but equal to or shorter than 75% of a one-field period.

The light emitting timing determination section 23 operates to supply a start pulse DSST for providing a start timing of each light emitting period and an end pulse DSET for providing an end timing of each light emitting period to the second scanning line driving section 7 together with a clock DSCK.

B. Driving Examples

B-1. Driving Example 1 of the Display Panel

Here, a driving example where the start timing of the first-time light emitting period and the end timing of the last-time light emitting period are fixed and the start timings and the end timings of each light emitting periods are determined so as to satisfy the ratio DUTY is described.

Figure 18:
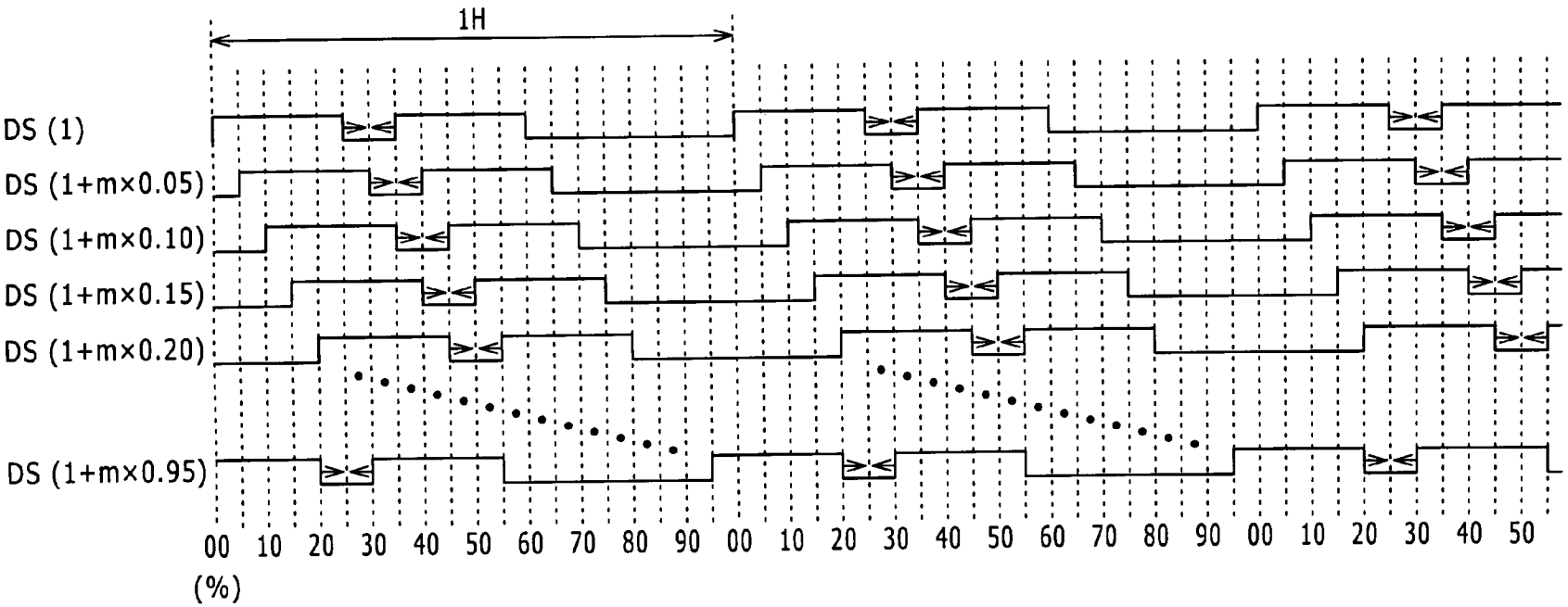
FIGS. 18 and 19 are timing charts illustrating different examples of driving timings of the organic EL panel of FIG. 17 according to a driving example 1.
Figure 19:
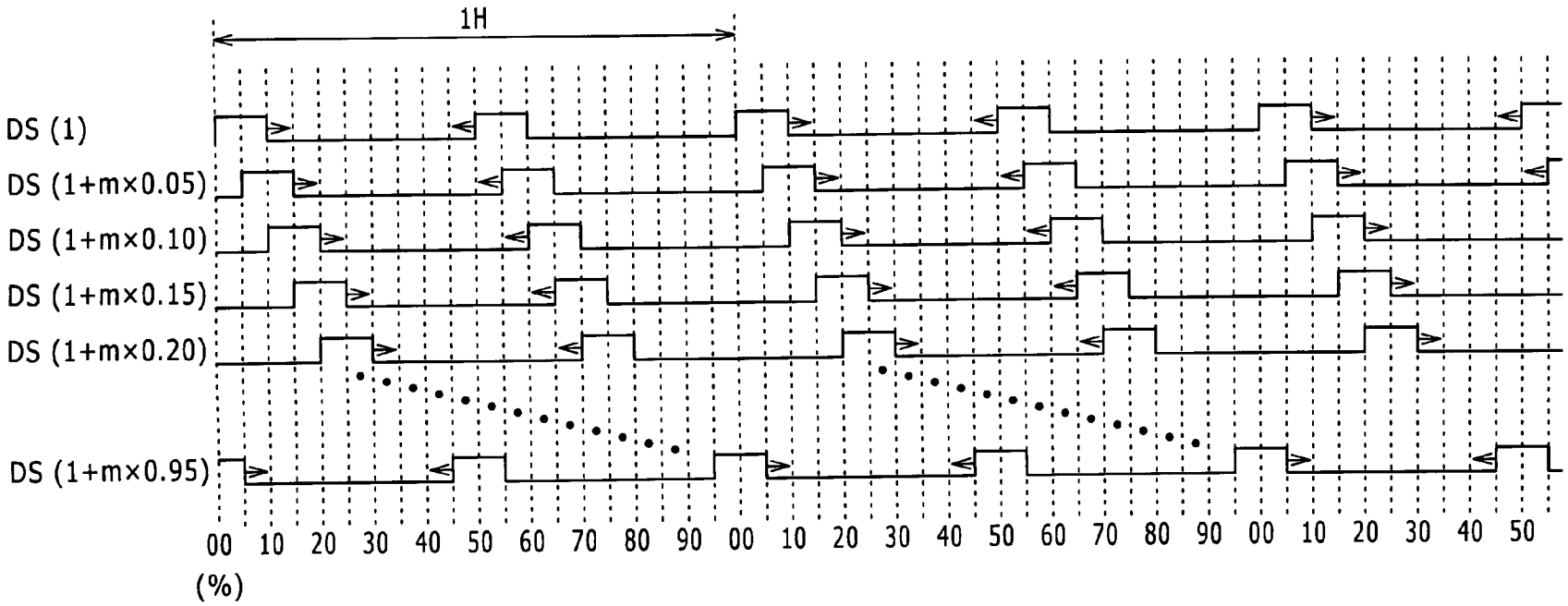

FIGS. 18 and 19 illustrate examples of a driving timing of the second scanning line VSCAN2 where a one-field period includes two light emitting periods. In both of the examples of FIGS. 18 and 19, the start timing of the first-time light emitting period is fixed to 0% of a one-field period, and the start timing of the second-time light emitting period is fixed to 60% of a one-field period. It is to be noted that FIG. 18 corresponds to a case wherein the total light emitting period length is comparatively long, but FIG. 19 corresponds to another case wherein the total light emitting period length is comparatively short.

Incidentally, while it is represented in FIGS. 18 and 19 that the phase relationship makes one cycle with 20 lines similarly as in the examples in related art described hereinabove, actually the phase relationship is set so as to make one cycle with M lines.

At this time, the light emitting timing determination section 23 determines the light emitting period corresponding to the sth scanning line VSCAN2(*s*) in accordance with the expression given below.

However, the following calculation expressions are represented such that a one-field period is given by m horizontal scanning periods. Further, the sth scanning line VSCAN2(*s*) is represented such that writing operation is carried out within the sth horizontal scanning period and emission of light is started simultaneously. Further, the ratio of the total light emitting period occupying within a one-field period T is represented by DUTY. It is to be noted that, if a result of the calculation does not become an integral value, then the corresponding timing is adjusted in a unit of a clock.

At this time, the light emitting period and the no-light emitting period are given by the following expressions:

First-Time Light Emitting Period:

$$[(s-1)/mJ\cdot T<t<\{[(s-1)/m]+\mathrm{DUTY}/2\}\cdot T$$

First-Time No-Light Emitting Period:

$$\{[(s-1)/m]+\mathrm{DUTY}/2\}\cdot T<t<\{[(s-1)/mJ+0.6-\mathrm{DUTY}/2\}\cdot T$$

Second-Time Light Emitting Period:

$$\{[(s-1)/mJ+0.6-\mathrm{DUTY}/2\}\cdot T<t<\{[(s-1)/mJ+0.6\}\cdot T$$

Second-Time No-Light Emitting Period:

$$\{[(s-1)/mJ+0.6\}\cdot T<t<\{[(s-1)/mJ+1\}\cdot T$$

where t is a period which satisfies the following expression:

$$[(s-1)/mJ\cdot T<t<\{[(s-1)/mJ+1\}\cdot T$$

In the case of the present driving example, the total light emitting period can be variably controlled within the range of 0% to 60% of the one-field period T.

Besides, where the present driving example is viewed from the point of view of motion artifact and flickering, this is equivalent to a case wherein the light emitting period is set to 0% to 60% of a one-field period. Accordingly, deterioration of the picture quality can be suppressed from the point of view of both of flickering and motion artifact. As a result, even if the peak luminance level is adjusted over a wide range, a method which does not involve deterioration of the picture quality can be implemented.

B-2. Driving Example 2 of the Display Panel

Figure 20:
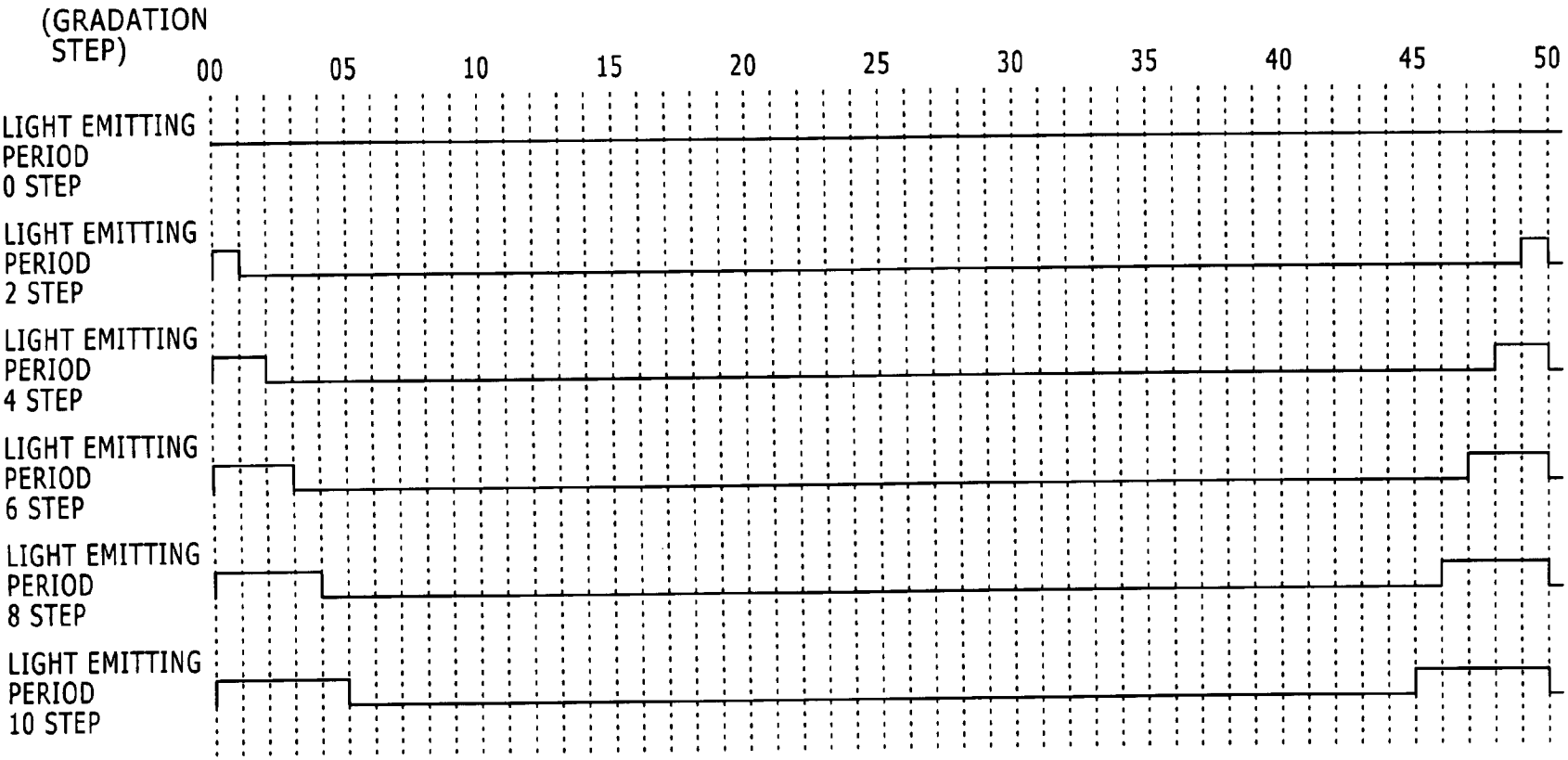
FIG. 20 is a timing chart illustrating a minimum adjustment amount of a light emitting period in the organic EL panel of FIG. 17 according to the driving example 1.

Incidentally, in the case of the driving example 1, it is necessary to vary the first-time light emitting period and the second-time light emitting period simultaneously by an equal adjustment amount as seen in FIG. 20. In particular, if the end timing of the first-time light emitting period is varied by 1%, then it is necessary to vary the start timing of the second-time light emitting period simultaneously by 1%.

Therefore, when compared with an alternative case wherein a one-field period includes one light emitting period, the adjustment amount of the light emitting periods decreases to ½. In other words, when compared with the alternative case wherein a one-field period includes one light emitting period, the minimum adjustment width of the light emission luminance becomes doubled.

Such a characteristic as just described is not preferable from a point of view that the light emission luminance is adjusted smoothly.

Therefore, in the present driving example, the display panel incorporates a function of varying, upon variation of the ratio DUTY by a minimum adjustment width, only one of the end timing of the first-time light emitting period and the start timing of the second-time light emitting period alternately by the minimum adjustment width.

Figure 21:
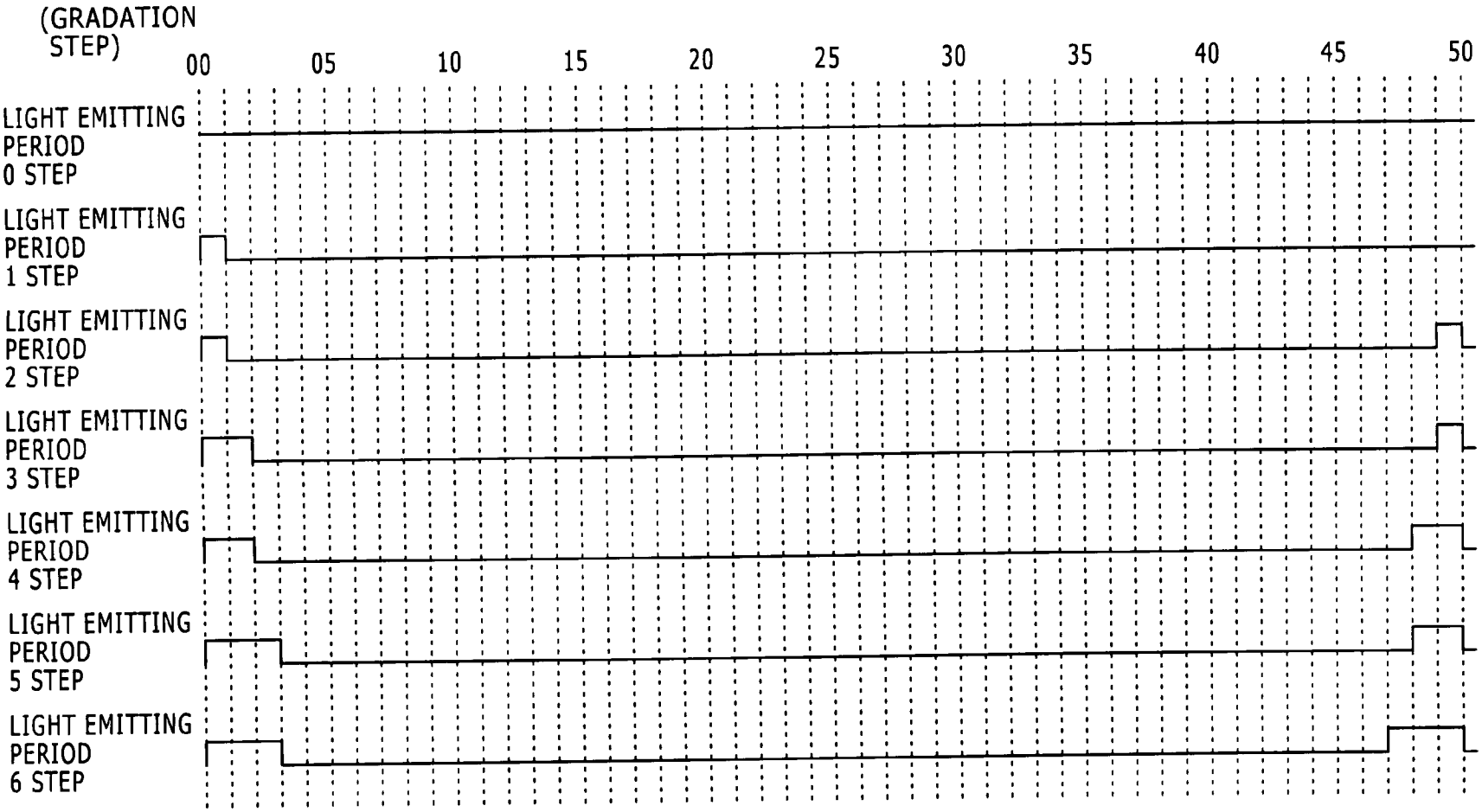
FIG. 21 is a timing chart illustrating a minimum adjustment amount of a light emitting period in the organic EL panel of FIG. 17 according to a driving example 2.

FIG. 21 illustrates an example of driving timings corresponding to the driving method described above. By the adoption of the driving method, the minimum adjustment width can be reduced when compared with that in the driving example 1, and simultaneously the luminance variation amount per minimum adjustment width can be reduced. It is to be noted that, although a case wherein the first-time light emitting period length and the second-time light emitting period length become asymmetrical occurs, this does not matter in practical use.

B-3. Driving Example 3 of the Display Panel

In the case of the driving example 1 described hereinabove, the start timing of the first-time light emitting period and the end timing of the second-time light emitting period are fixed for the maximum variation range (0% to 60% of the total light emitting period) of the peak luminance level.

However, another method may be adopted wherein the start timing of the first-time light emitting period and the end timing of the second-time light emitting period are fixed only within part of the variation range and, when the part of the variation range is exceeded, one light emitting period is provided and the end timing is gradually prolonged. For example, such a method may be adopted that, within a range shorter than 40% of a one-field period, the light emitting period is divided into two periods, but within a range of 40% to 60% of a one-field period, one light emitting period is provided and the period length is gradually extended.

Figure 22:
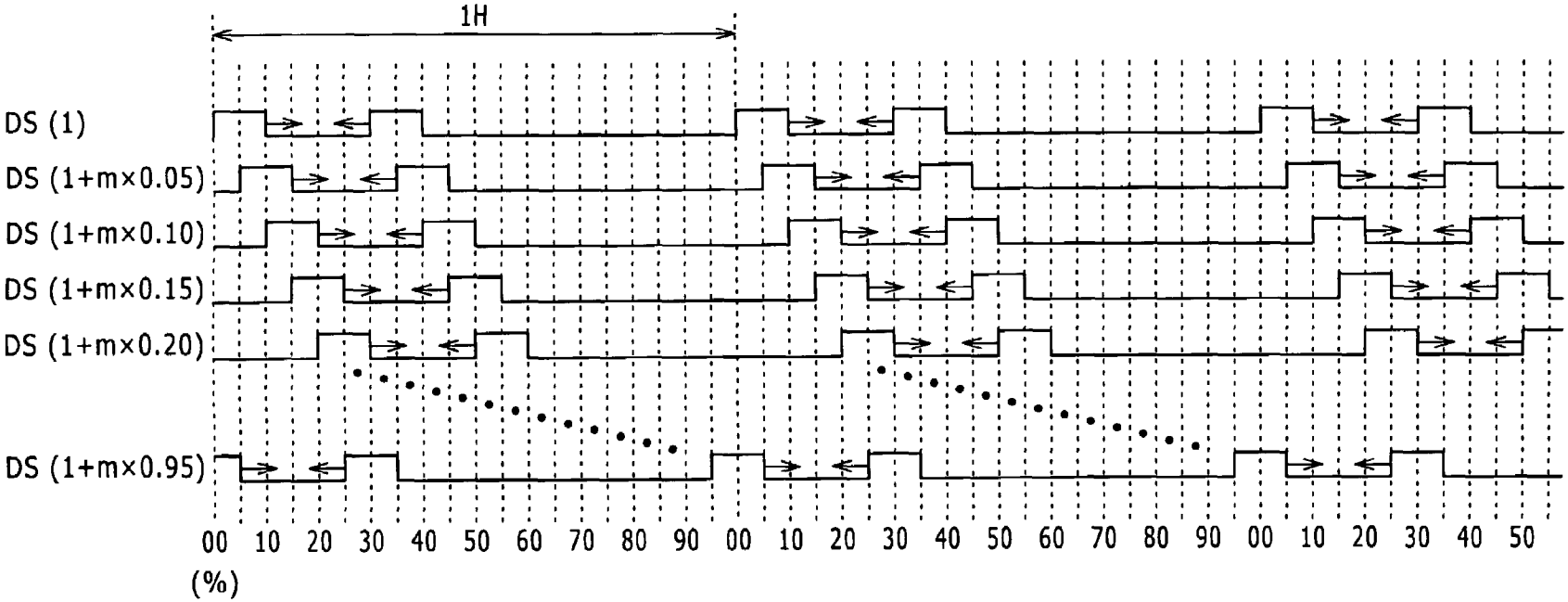
FIGS. 22, 23 and 24 are timing charts illustrating different examples of driving timings of the organic EL panel of FIG. 17 according to a driving example 3.
Figure 23:
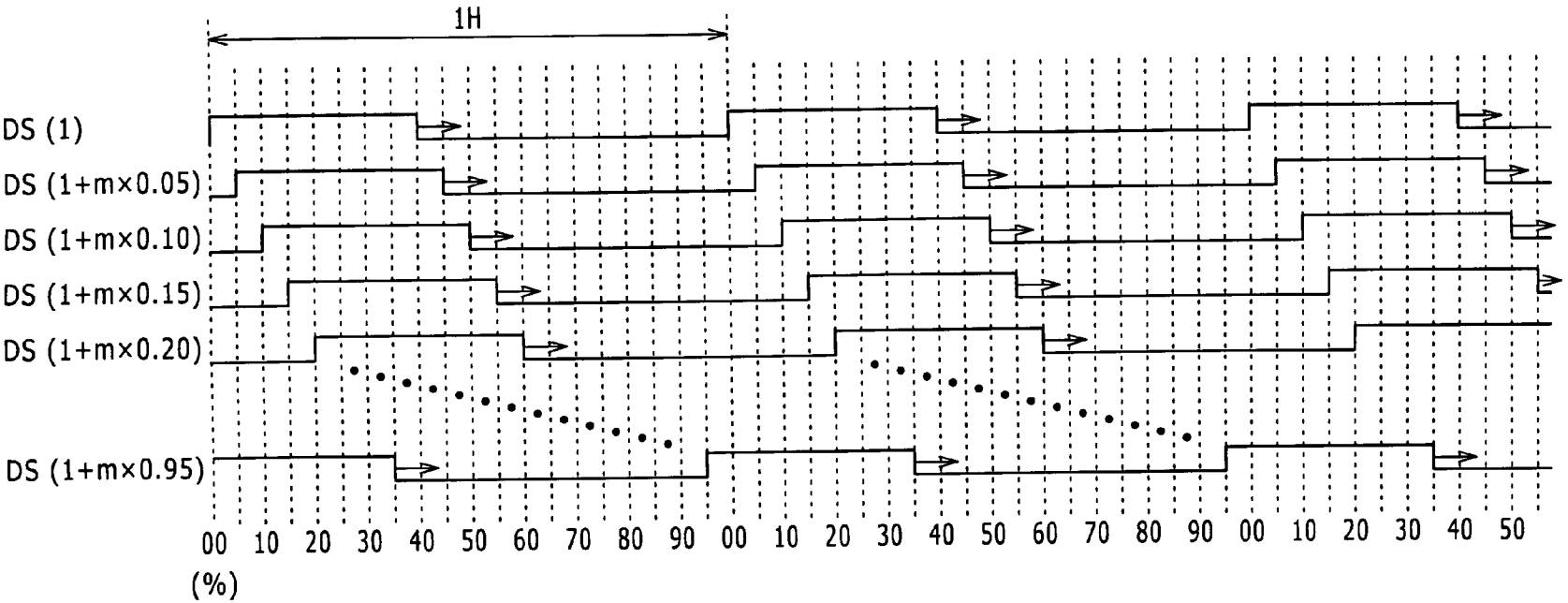
Figure 24:
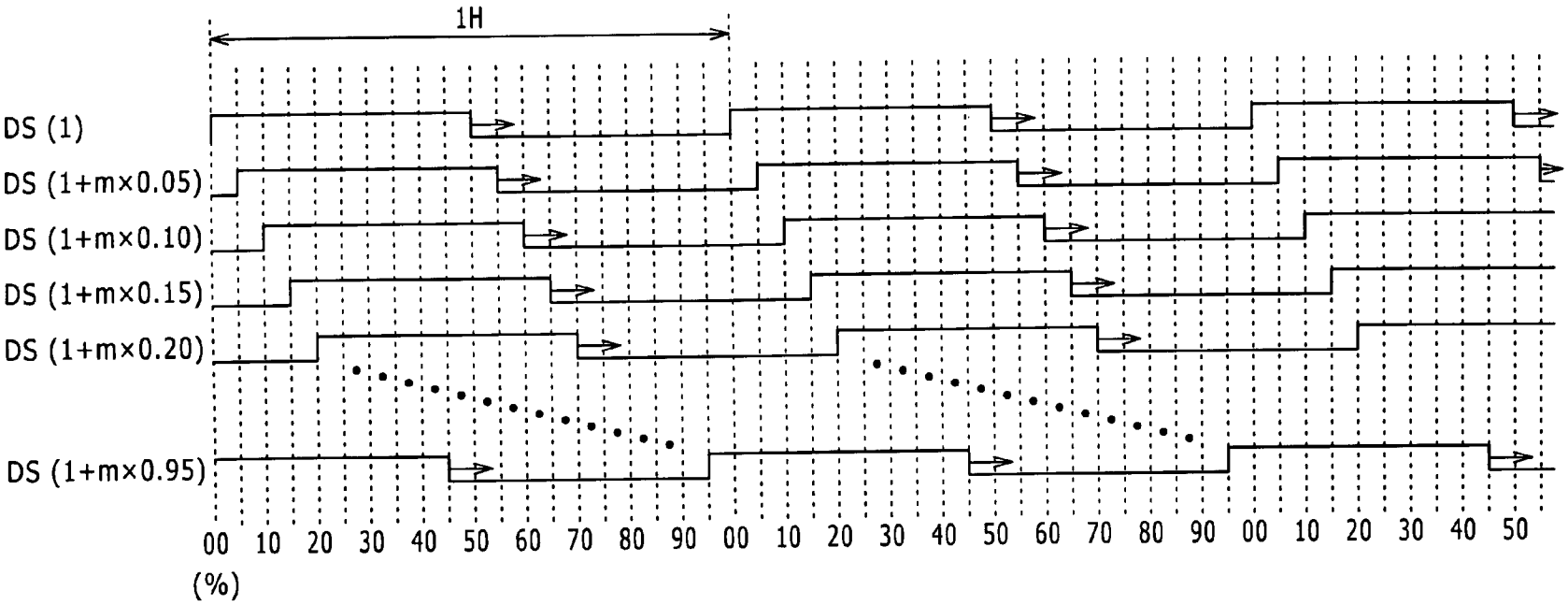

FIGS. 22 to 24 illustrate examples of driving timings of the second scanning line VSCAN2 corresponding to the method just described.

It is to be noted that the FIG. 22 illustrates an example of driving where the total light emitting period length (ratio DUTY) designated from the outside is given by less than 40% of a one-field period. Meanwhile, FIG. 23 illustrates an example of driving where the ratio DUTY designated from the outside is provided by 40% of a one-field period.

Further, FIG. 24 illustrates an example of driving where the total light emitting period length (ratio DUTY) designated from the outside is provided by 40% to 60% of a one-field period.

Incidentally, also in the cases of FIGS. 22 to 24, the phase relationship makes one cycle with 20 lines similarly as in the driving examples described hereinabove, actually the phase relationship is set so as to make one cycle with M lines.

At this time, the light emitting timing determination section 23 determines the light emitting period corresponding to the sth scanning line VSCAN2(*s*) in accordance with an expression given below.

However, also in the case of the calculation expression given below, it is assumed that a one-field period is given by m horizontal scanning periods. Also it is assumed that a writing operation into the sth scanning line VSCAN2(*s*) is carried out within the sth horizontal scanning period and light emission is carried out simultaneously.

Further, the ratio of the light emitting period occupying in a one-field period T is represented by DUTY. It is to be noted that, if a result of the calculation does not become an integral value, then the corresponding timing is adjusted in a unit of a clock.

At this time, the light emitting period and the no-light emitting period are given by the following expressions:

where 0<DUTY<0.4,

First-Time Light Emitting Period:

$$[(s-1)/mJ\cdot T<t<\{[(s-1)/m]+\mathrm{DUTY}/2\}\cdot T$$

First-Time No-Light Emitting Period:

$$\{[(s-1)/m]+\mathrm{DUTY}/2\}\cdot T<t<\{[(s-1)/mJ+0.4-\mathrm{DUTY}/2\}\cdot T$$

Second-Time Light Emitting Period:

$$\{[(s-1)/mJ+0.4-\mathrm{DUTY}/2\}\cdot T<t<\{[(s-1)/mJ+0.4\}\cdot T$$

Second-Time No-Light Emitting Period:

$$\{[(s-1)/mJ+0.4\}\cdot T<t<\{[(s-1)/mJ+1\}\cdot T$$

where 0.4<DUTY<0.6,

Light Emitting Period:

$$[(s-1)/mJ\cdot T<t<\{[(s-1)/m]+\mathrm{DUTY}\}\cdot T$$

No-Light Emitting Period:

$$\{[(s-1)/m]+\mathrm{DUTY}\}\cdot T<t<\{[(s-1)/mJ+1\}\cdot T$$

In the present driving example, where the total light emitting period length (ratio DUTY) occupying in a one-field period T is less than 40% of the one-field period T, the light emitting period is divided into two periods for driving. Consequently, the apparent ratio of the light emitting period can be made equal to 40%, and deterioration of the picture quality by flickering can be minimized as much.

On the other hand, where the total light emitting period length (ratio DUTY) occupying in a one-field period T is equal to or longer than 40% but equal to or shorter than 60%, one light emitting period is used for driving. Consequently, from the point of view of both of flickering and motion artifact, the peak luminance level can be adjusted over a wide range while deterioration of the picture quality is suppressed.

Naturally, also in this instance, a driving method similar to that of the driving example 2 may be adopted. In particular, where the total light emitting period length (ratio DUTY) occupying in a one-field period T is shorter than 40% of the one-field period T, only one of the end timing of the first-time light emitting period and the start timing of the second-time light emitting period may be varied by a minimum adjustment amount.

B-4. Driving Example 4 of the Display Panel

In the case of the driving example 1 described hereinabove, the start timing of the first-time light emitting period and the end timing of the second-time light emitting period are fixed for the maximum variation range (0% to 60% of the total light emitting period) of the peak luminance level.

On the other hand, in the case of the driving example 3 described hereinabove, the start timing of the first-time light emitting period and the end timing of the second-time light emitting period are fixed for only part of the maximum variation range of the peak luminance level, and where the part of the range is exceeded, only one light emitting period is used and the light emitting period length is extended simply.

However, for the second-time (last-time) light emitting period, a method of variably controlling also the end timing of the light emitting period in response to the ratio DUTY of the light emitting period may be used in combination with the driving example 1.

However, since the end timing of the second-time (last-time) light emitting period is prolonged, if the total light emitting period exceeds 75% of a one-field period, then deterioration of the picture quality by motion artifact becomes conspicuous. Accordingly, it is demanded to determine a reference point for the second-time light emitting period so that a maximum variation range of the peak luminance level is satisfied.

Here, a case is described wherein the position of two thirds of an estimated maximum variation range is determined as a base point of the second-time light emitting period. In particular, two light emitting periods are determined preceding to the base point, and the end timing of the second-time light emitting period is determined at a point later than the base point.

For example, where the estimated maximum variation range is given by 0% to 60% of a one-field period, the base point for the second-time light emitting period is determined at the position of 40% from the top of the one-field period.

It can be considered that this is similar to that where 60% which are the maximum variation range are virtually divided into three light emitting periods of 20% to carry out control. In this instance, it may be considered that the end timing of the second-time light emitting period and the start timing of the third-time light emitting period are fixed to 40%.

Figure 25:
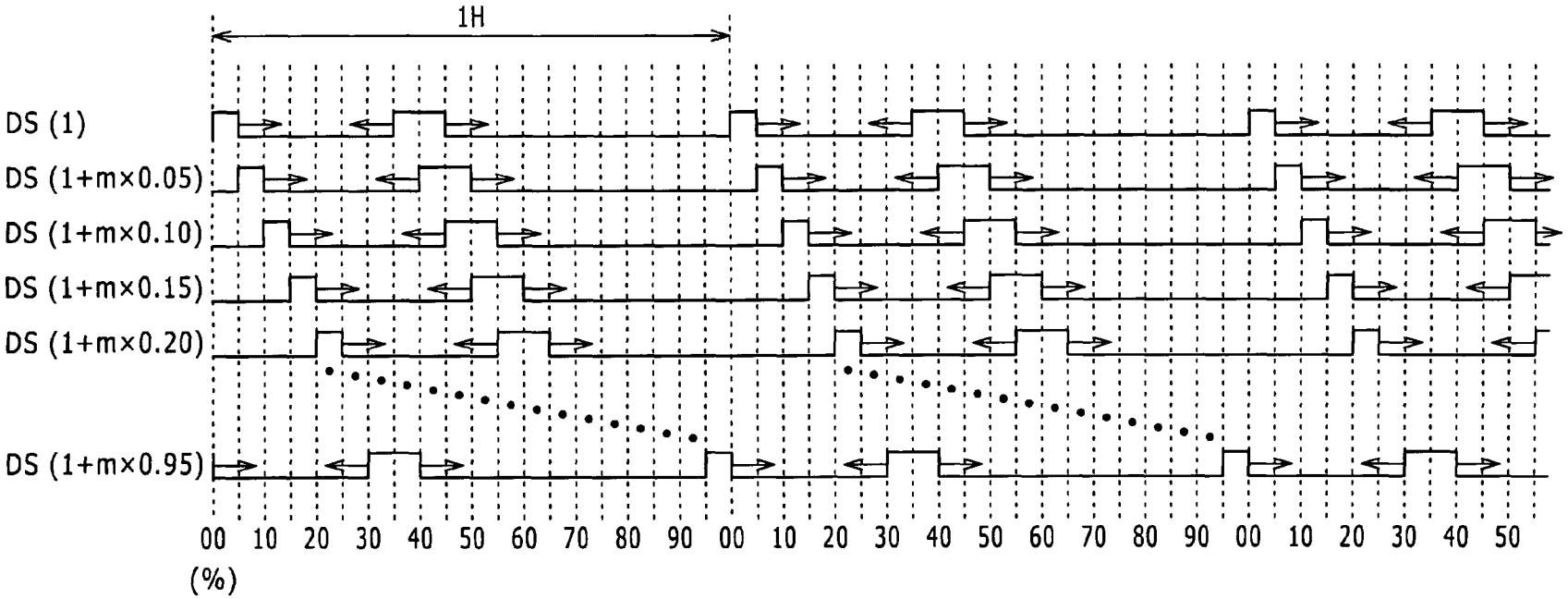
FIGS. 25 and 26 are timing charts illustrating different examples of driving timings of the organic EL panel of FIG. 17 according to a driving example 4.
Figure 26:
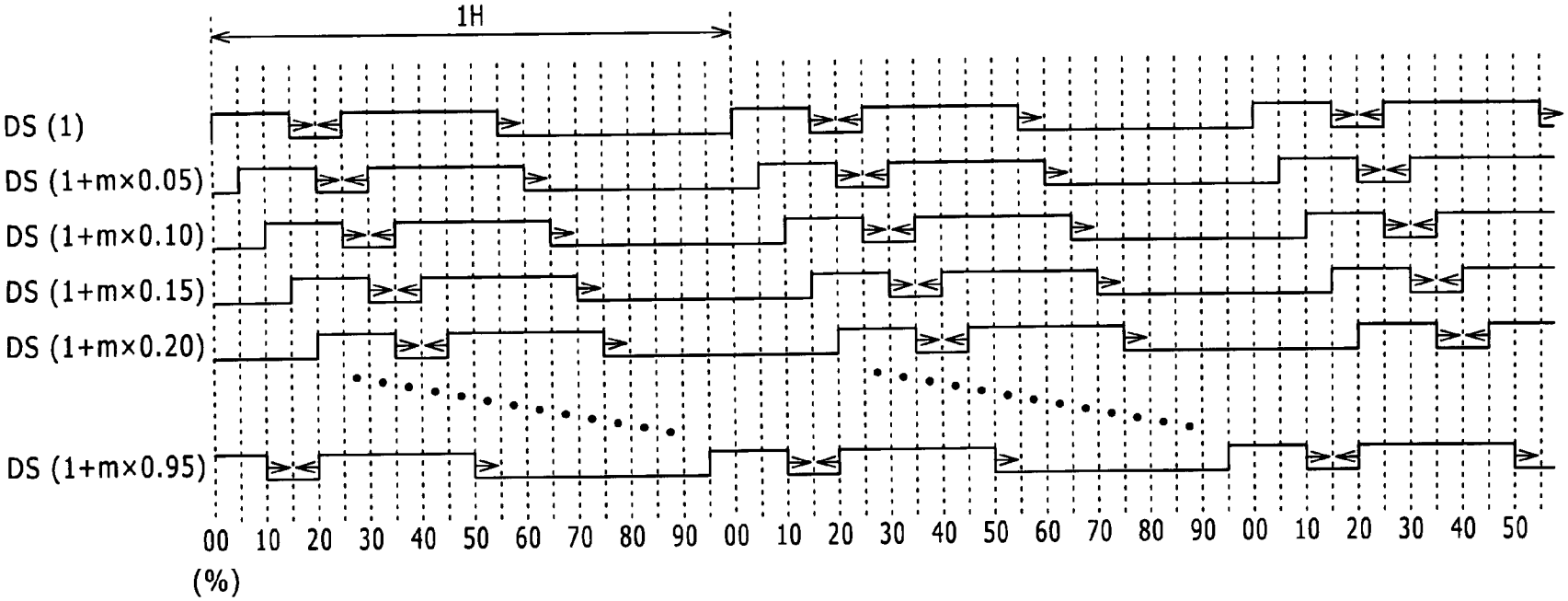

FIGS. 25 and 26 illustrate examples of driving timings of the second scanning line VSCAN2 where two light emitting periods are defined within a one-field period.

It is to be noted that FIG. 25 illustrates an example of driving where the total light emitting period length (ratio DUTY) designated from the outside is comparatively short. Meanwhile, FIG. 26 illustrates an example of driving where the total light emitting period length (ratio DUTY) designated from the outside is comparatively long.

While, also in the cases of FIGS. 25 and 26, the phase relationship makes one cycle with 20 lines similarly as in the driving examples described hereinabove, actually the phase relationship is set so as to make one cycle with M lines.

At this time, the light emitting timing determination section 23 determines the light emitting periods corresponding to the sth scanning line VSCAN2(*s*) in accordance with an expression given below.

However, also in the case of the calculation expression given below, it is assumed that a one-field period is given by m horizontal scanning periods. Also it is assumed that a writing operation into the sth scanning line VSCAN2(*s*) is carried out within the sth horizontal scanning period and light emission is carried out simultaneously.

Further, the ratio of the light emitting period occupying in a one-field period T is represented by DUTY. It is to be noted that, if a result of the calculation does not become an integral value, then the corresponding timing is adjusted in a unit of a clock.

At this time, the light emitting period and the no-light emitting period are given by the following expressions:

where 0<DUTY<0.6,

First-Time Light Emitting Period:

$$[(s-1)/mJ\cdot T<t<\{[(s-1)/m]+\mathrm{DUTY}/3\}\cdot T$$

First-Time No-Light Emitting Period:

$$\{[(s-1)/m]+\mathrm{DUTY}/3\}\cdot T<t<\{[(s-1)/mJ+0.4-\mathrm{DUTY}/3\}\cdot T$$

Second-Time Light Emitting Period:

$$\{[(s-1)/mJ+0.4-\text{DUTY}/3\}\cdot T<t<\{[(s-1)/mJ+0.4+\text{DUTY}/3\}\cdot T$$

Second-Time No-Light Emitting Period:

$$\{[(s-1)/mJ+0.4+\text{DUTY}/3\}\cdot T<t<\{[(s-1)/mJ+1\}\cdot T$$

In the present driving example, the total light emitting period length (ratio DUTY) occupying in a one-field period T can be controlled within the range of 0% to 60%. Simultaneously, from the point of view of flickering and motion artifact, effects similar to those of the variation control based on the light emission period of 40% to 60% can be implemented.

In particular, in the present driving example, although the end timing of the second-time light emitting period is not fixed, since the start timing of the second-time light emitting period increases or moves forwardly together with increase of the light emitting period, deterioration of the picture quality by flickering and motion artifact can be minimized similarly as in the driving examples described hereinabove.

C. Driving Examples

C-1. Driving Example 5 of the Display Panel

Here, an example of driving wherein the end timing of light emitting periods is variably determined such that a given total light emitting period length (ratio DUTY) is satisfied in a state wherein the distance between start timings of each adjacent ones of the light emitting periods is defined so as to be shorter than a length obtained by dividing a one-field period by the number N (≥2) of the light emitting periods.

Figure 27:
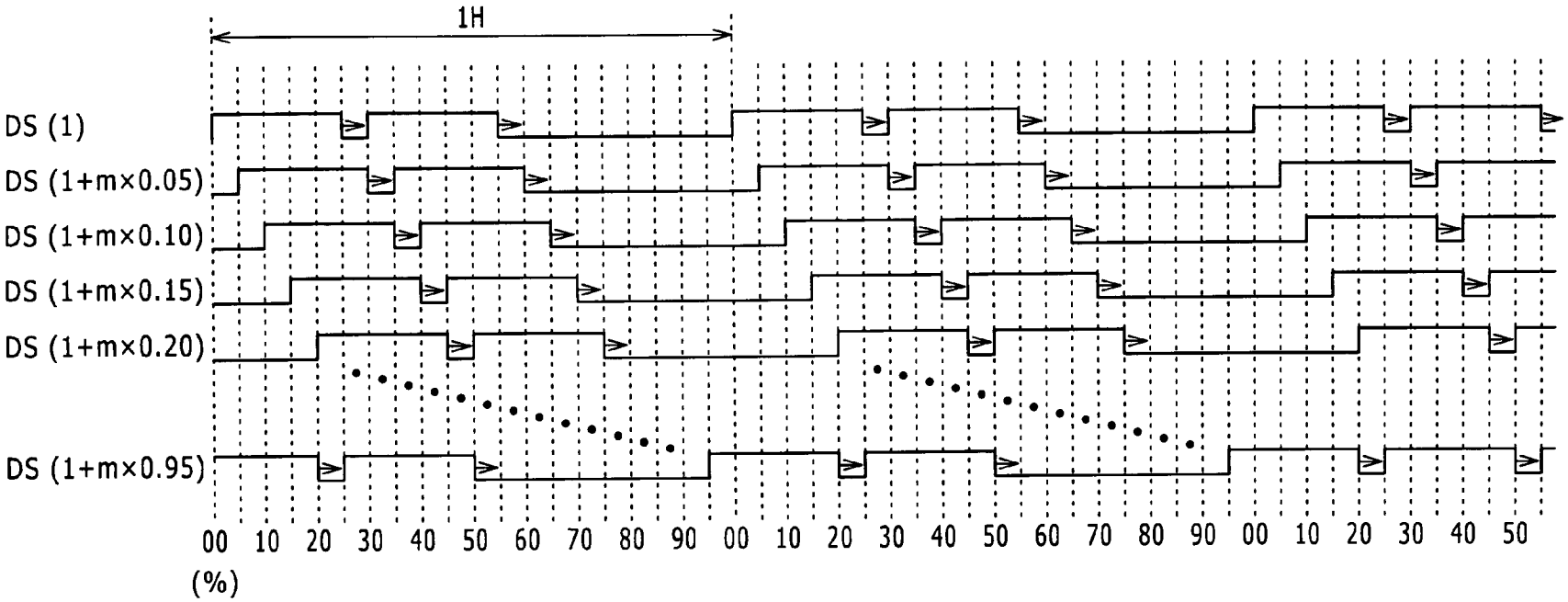
FIGS. 27 and 28 are timing charts illustrating different examples of driving timings of the organic EL panel of FIG. 17 according to a driving example 5.
Figure 28:
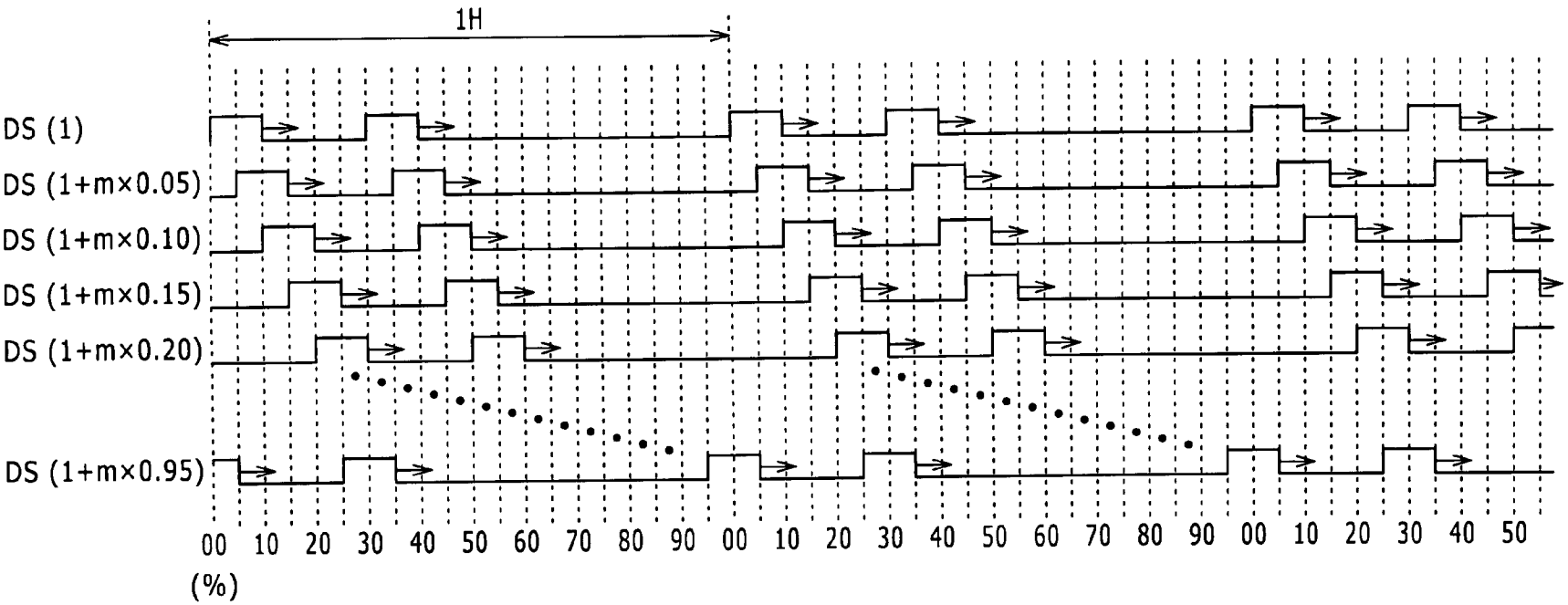
Figure 29:
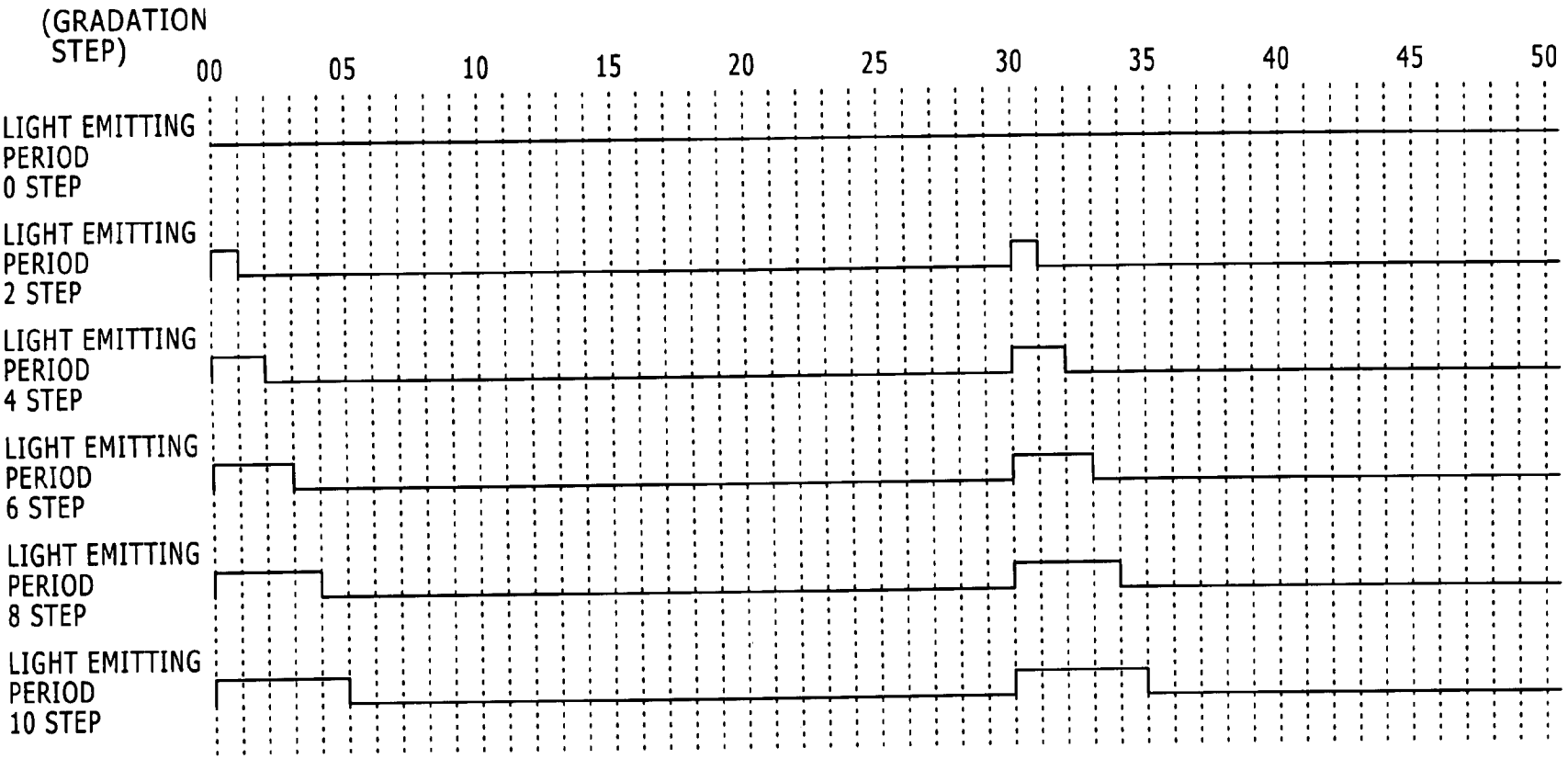
FIG. 29 is a timing chart illustrating a minimum adjustment amount of a light emitting period in the organic EL panel of FIG. 17 according to the driving example 5.

FIGS. 27 and 28 illustrate examples of driving timings of the second scanning line VSCAN2 where a one-field period includes two light emitting periods. In both of the examples of FIGS. 27 and 28, the start timing of the first-time light emitting period is set to 0% and the start timing of the second-time light emitting period is fixed to 30% of the one-field period. It is to be noted that FIG. 27 illustrates an example of driving where the total light emitting period length is comparatively long while FIG. 28 illustrates an example of driving where the total light emitting period length is comparatively short.

Incidentally, also in the cases of FIGS. 27 and 28, the phase relationship makes one cycle with 20 lines similarly as in the driving examples described hereinabove, actually the phase relationship is set so as to make one cycle with M lines.

At this time, the light emitting timing determination section 23 determines the light emitting period corresponding to the sth scanning line VSCAN2(*s*) in accordance with an expression given below.

However, also in the case of the calculation expression given below, it is assumed that a one-field period is given by m horizontal scanning periods. Also it is assumed that a writing operation into the sth scanning line VSCAN2(*s*) is carried out within the sth horizontal scanning period and light emission is carried out simultaneously. Further, the ratio of the light emitting period occupying in a one-field period T is represented by DUTY. It is to be noted that, if a result of the calculation does not become an integral value, then the corresponding timing is adjusted in a unit of a clock.

At this time, the light emitting period and the no-light emitting period are given by the following expressions:

First-Time Light Emitting Period:

$$[(s-1)/mJ\cdot T<t<\{[(s-1)/m]+\text{DUTY}/2\}\cdot T$$

First-Time No-Light Emitting Period:

$$\{[(s-1)/m]+\text{DUTY}/2\}\cdot T<t<\{[(s-1)/mJ+0.3\}\cdot T$$

Second-Time Light Emitting Period:

$$\{[(s-1)/mJ+0.3\}\cdot T<t<\{[(s-1)/m]+\text{DUTY}/2\}\cdot T$$

Second-Time No-Light Emitting Period:

$$\{[(s-1)/m]+\text{DUTY}/2\}\cdot T<t<\{[(s-1)/mJ+1\}\cdot T$$

where t is a period which satisfies the following expression:

$$[(s-1)/mJ\cdot T<t<\{[(s-1)/mJ+1\}\cdot T$$

In the present driving example, the distance between the start timings of adjacent light emitting periods is 30%. Accordingly, even if the total light emitting period length is close to 0%, from the point of view of flickering and motion artifact, a visual effect equal to that within a light emitting period which is 30% of a one-field period can be obtained.

Also where the total light emitting period length gradually increases from 0%, the increasing amount is allocated uniformly to the two light emitting periods.

Therefore, even at a point of time at which the total light emitting period length approaches 60%, from the point of view of flickering and motion artifact, a visual effect equal to that within a light emitting period which is 60% of a one-field period can be obtained.

It is to be noted that, with the method in related art, even where the total light emitting period length is 60% similarly, from the point of view of flickering and motion artifact, a visual effect equal to that where the light emitting period is 80% of a one-field period is provided.

In this manner, according to the driving method of the present driving example, even if the peak luminance level is adjusted over a wide range, for example, over a range from 0% to 60%, the adjustment range on the visual sensation from 25% or more to 75% or less of a one-field period can be satisfied. In other words, the driving method implements reduction of deterioration of the picture quality even if the peak luminance level is adjusted over the wide range.

C-2. Driving Example 6 of the Display Panel

Incidentally, in the case of the driving example 5, it is necessary to vary the first-time light emitting period and the second-time light emitting period simultaneously by an equal adjustment amount as seen in FIG. 27. In particular, if the end timing of the first-time light emitting period is varied by 1%, then it is necessary to vary the start timing of the second-time light emitting period simultaneously by 1%.

Therefore, when compared with an alternative case wherein a one-field period includes one light emitting period, the adjustment amount of the peak luminance level decreases to ½. In other words, when compared with the alternative case wherein a one-field period includes one light emitting period, the minimum adjustment width of the peak luminance level becomes doubled.

Such a characteristic as just described is not preferable from a point of view that the light emission luminance is adjusted smoothly.

Therefore, in the present driving example, the display panel incorporates a function of varying, upon variation of the peak luminance level (ratio DUTY) by a minimum adjustment width, only one of the end timing of the first-time light emitting period and the start timing of the second-time light emitting period alternately by the minimum adjustment width.

Figure 30:
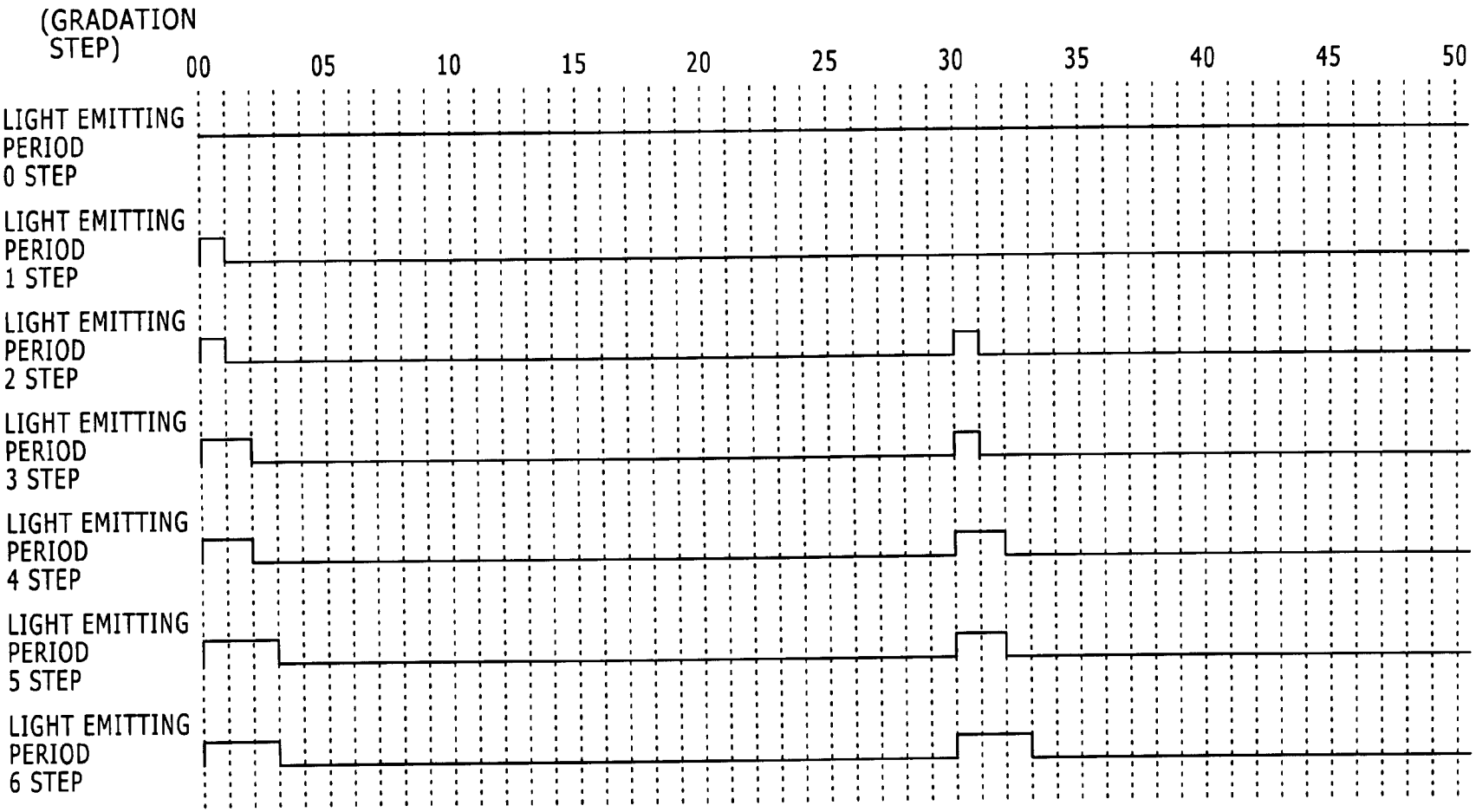
FIG. 30 is a similar view but illustrating a minimum adjustment amount of a light emitting period in the organic EL panel of FIG. 17 according to the driving example 6.

FIG. 30 illustrates an example of driving timings corresponding to the driving method described above. By the adoption of the driving method, the minimum adjustment width can be reduced when compared with that in the driving example 5, and simultaneously the luminance variation amount per minimum adjustment width can be reduced. It is to be noted that, although a case wherein the first-time light emitting period length and the second-time light emitting period length become asymmetrical appears, this does not matter in practical use.

C-3. Driving Example 7 of the Display Panel

In the case of the driving example 5 described hereinabove, two light emitting periods are disposed in a one-field period except the maximum value (60%) of the variation range of the peak luminance level.

However, another method may be adopted wherein a light emitting period within a one-field period is divided into two periods only within part of the variation range, and after the part of the variation range is exceeded, only the end timing of the one light emitting period which is a combination of the two light emitting periods is gradually prolonged.

In the following description, it is assumed that, only where the total light emitting period length (ratio DUTY) which provides an adjustment amount for the peak luminance level is given by 40% or less of a one-field period, a driving method which presupposes disposition of two light emitting periods is applied, but where the total light emitting period length (ratio DUTY) exceeds 40% of a one-field period, another driving method which presupposes disposition of one light emitting period is applied.

Also it is assumed that the maximum variation range of the total light emitting period length (ratio DUTY) is given by 0% to 60%.

Figure 31:
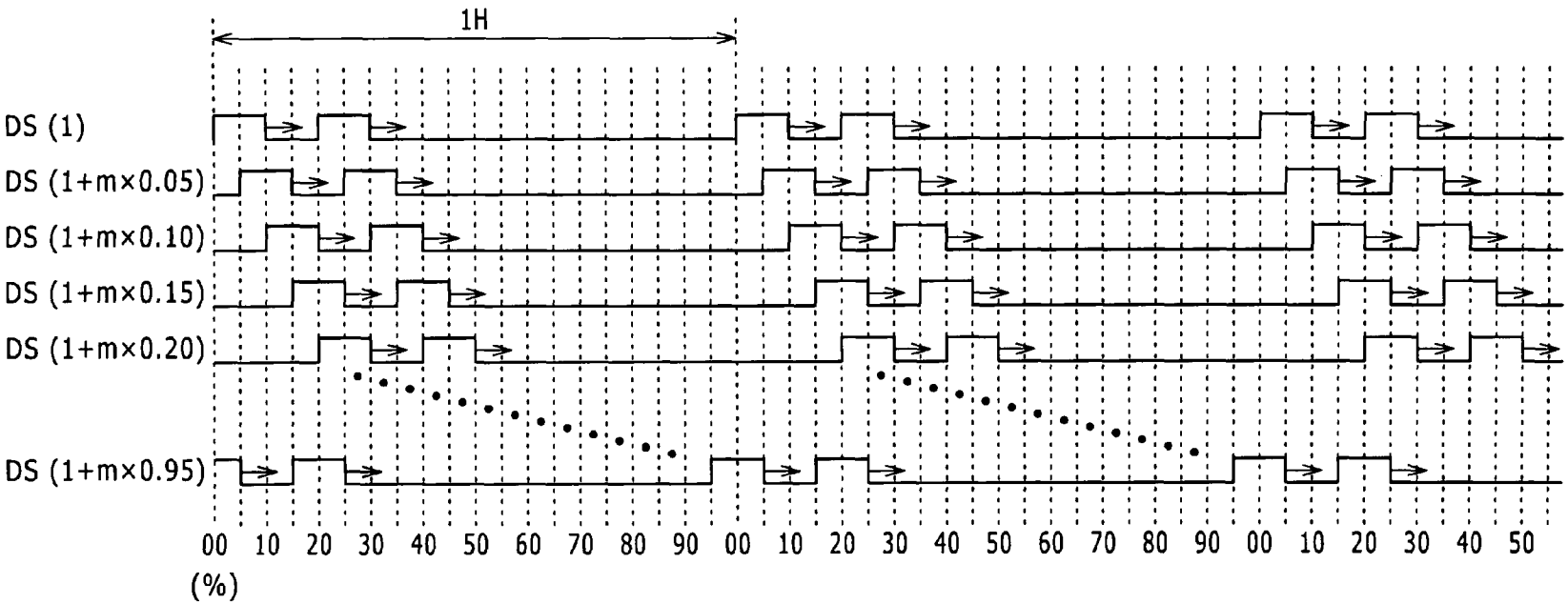
FIGS. 31, 32 and 33 are timing charts illustrating different examples of driving timings of the organic EL panel of FIG. 17 according to a driving example 7.
Figure 32:
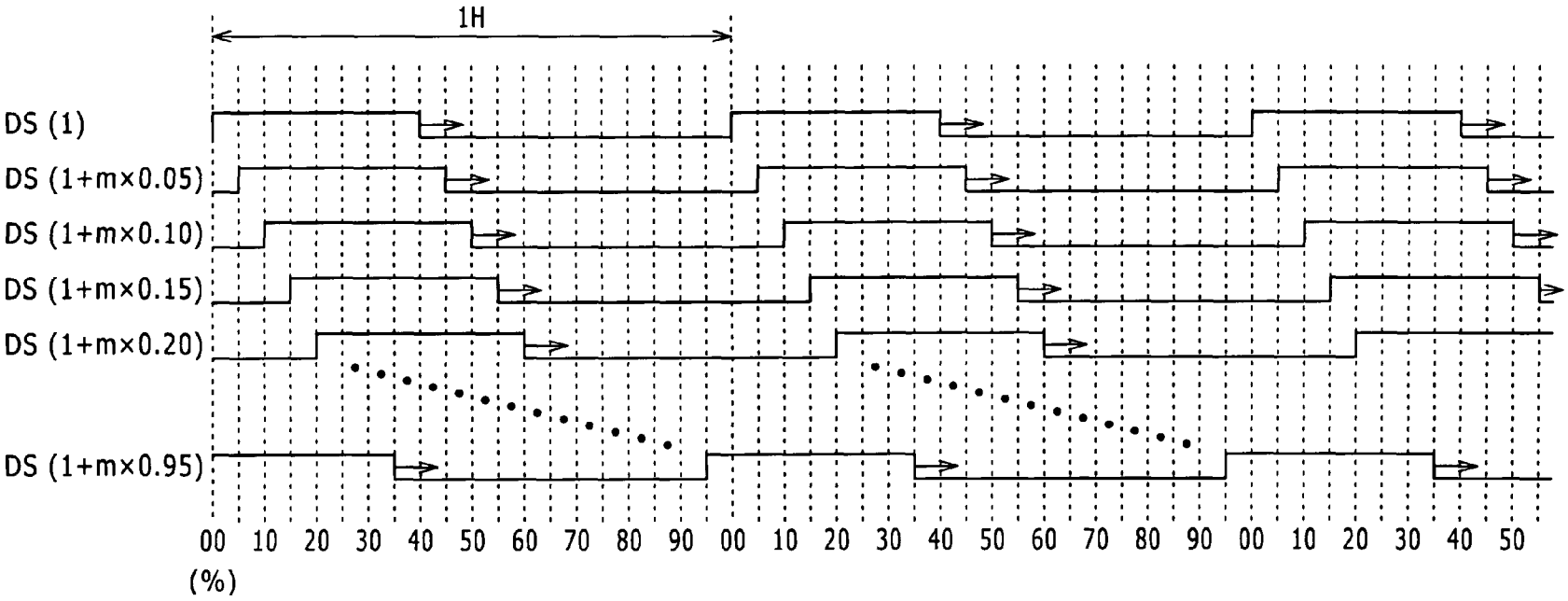
Figure 33:
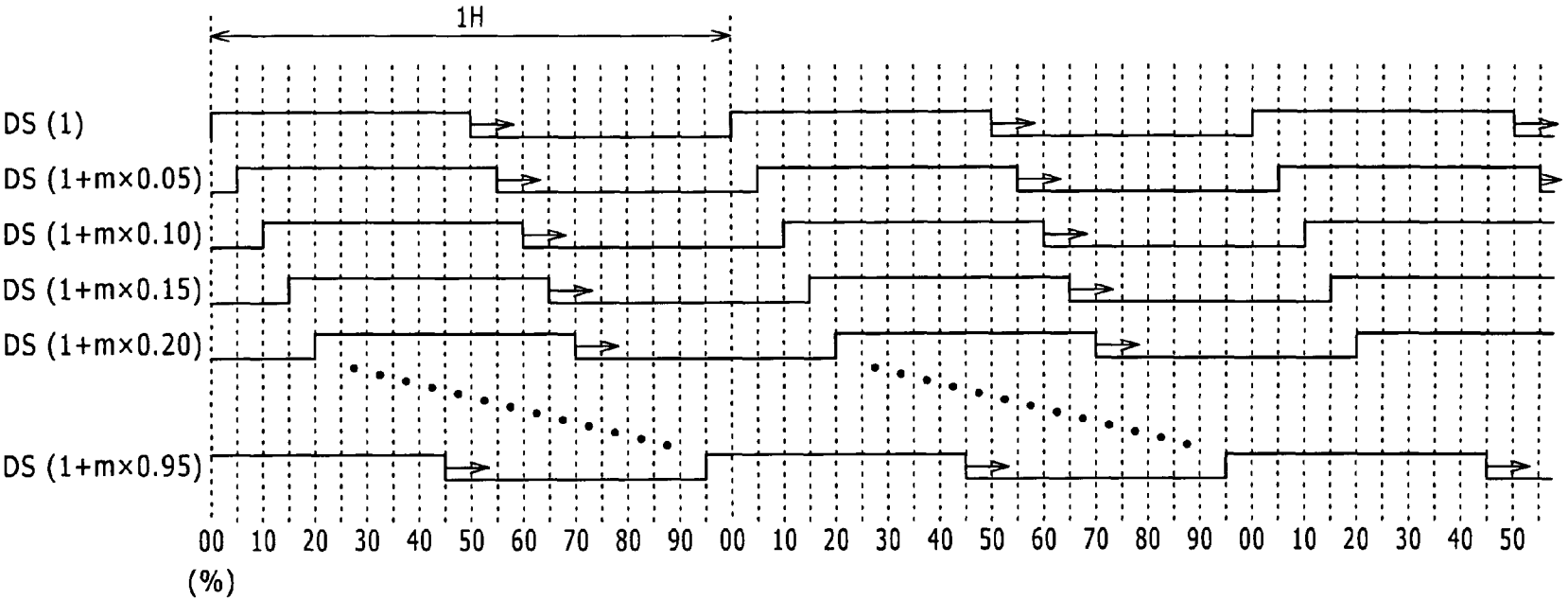

FIGS. 31 to 33 illustrate examples of driving timings of the second scanning line VSCAN2 corresponding to the driving method just described.

It is to be noted that the FIG. 31 illustrates an example of driving where the total light emitting period length (ratio DUTY) designated from the outside is given by less than 40% of a one-field period. In this instance, the start timing of the second-time light emitting period is fixed to 20%.

More specifically, FIG. 31 illustrates the driving method where the total light emitting period length (ratio DUTY) is 20%. Therefore, a light emitting period of 10% is allocated to each of the first-time light emitting period and the second-time light emitting period. The light emitting state of FIG. 31 provides, from the point of view of flickering and motion artifact, a visual effect equal to that where the light emitting period is 30% of a one-field period.

However, where the total light emitting period length is proximate to 0%, from the point of view of flickering and motion artifact, a visual effect equal to that within a light emitting period which is 20% of a one-field period may be obtained, and there is the possibility that the visual effect may become lower than that where the lighting emitting period is 25% of a one-field period with which good picture quality can be obtained.

However, the light emitting period on the visual effect becomes lower than 25% of a one-field period only where the ratio DUTY is lower than 10% of the total light emitting period length. Besides, the light emitting period on the visual effect can be 20% of a one-field period at the lowest. Accordingly, when compared with the technique in related art, deterioration of the picture quality by flickering can be reduced significantly.

FIG. 32 illustrates an example of driving where the total light emitting period length (ratio DUTY) designated from the outside is 40% of a one-field period. At this point of time, the two light emitting periods are merged, and the light emitting period on the visual effect and the actual light emitting period length become coincide with each other.

FIG. 33 illustrates an example of driving where the ratio DUTY of the light emitting period designated from the outside is 50% of a one-field period.

Incidentally, also in the cases of FIGS. 31 to 33, the phase relationship makes one cycle with 20 lines similarly as in the driving examples described hereinabove. However, actually the phase relationship is set so as to make one cycle with M lines.

At this time, the light emitting timing determination section 23 determines the light emitting period corresponding to the sth scanning line VSCAN2($s$) in accordance with an expression given below.

However, also in the case of the calculation expression given below, it is assumed that a one-field period is given by m horizontal scanning periods. Also it is assumed that writing operation into the sth scanning line VSCAN2($s$) is carried out within the sth horizontal scanning period and light emission is carried out simultaneously.

Further, the ratio of the light emitting period occupying in a one-field period T is represented by DUTY. It is to be noted that, if a result of the calculation does not become an integral value, then the corresponding timing is adjusted in a unit of a clock.

At this time, the light emitting period and the no-light emitting period are given by the following expressions:

where 0<DUTY<0.4,

First-Time Light Emitting Period:

$$[(s-1)/mJ\cdot T<t<\{[(s-1)/m]+\mathrm{DUTY}/2\}\cdot T$$

First-Time No-Light Emitting Period:

$$\{[(s-1)/m]+\mathrm{DUTY}/2\}\cdot T<t<\{[(s-1)/mJ+0.2\}\cdot T$$

Second-Time Light Emitting Period:

$$\{[(s-1)/mJ+0.2\}\cdot T<t<\{[(s-1)/m]+(0.2+\mathrm{DUTY}/2\}\cdot T$$

Second-Time No-Light Emitting Period:

$$\{([(s-1)/m]+(0.2+\mathrm{DUTY}/2\}\cdot T<t<\{[(s-1)/mJ+1\}\cdot T$$

where 0.4<DUTY<0.6,

Light Emitting Period:

$$[(s-1)/mJ\cdot T<t<\{[(s-1)/m]+\mathrm{DUTY}\}\cdot T$$

No-Light Emitting Period:

$$\{[(s-1)/m]+\mathrm{DUTY}\}-T<t<\{[(s-1)/mJ+1\}\cdot T$$

In the present driving example, where the total light emitting period length (ratio DUTY) occupying in a one-field period T is less than 40% of the one-field period T, the light emitting period is divided into two periods for driving. Consequently, the apparent ratio of the light emitting period can be increased from 20% to 40%. By this, deterioration of the picture quality by flickering can be minimized.

On the other hand, where the total light emitting period length (ratio DUTY) occupying in a one-field period T is equal to or longer than 40% but equal to or shorter than 60%, one light emitting period is used for driving. Consequently, from the point of view of flickering and motion artifact, deterioration of the picture quality can be suppressed.

In this manner, the peak luminance level can be adjusted over a wide range while deterioration of the picture quality is suppressed.

It is to be noted that, also in this instance, a driving method similar to that of the driving example 6 may be adopted. In particular, where the total light emitting period length (ratio DUTY) occupying in a one-field period T is shorter than 40% of the one-field period T, only one of the end timing of the first-time light emitting period and the end timing of the second-time light emitting period may be varied by a minimum adjustment amount.

C-4. Driving Example 8 of the Display Panel

In the case of the driving example 5 described hereinabove, where the peak luminance level is controlled by control of the length of two light emitting periods, the distance between the start timings of the two light emitting periods is set shorter than the period length (50%) which is one half of a one-field period. More particularly, the distance between the start timings of two adjacent light emitting periods is set to 30%.

However, control based on the total light emitting period length can be implemented also by control of each of three or more divisional light emitting periods.

Here, a driving example where four light emitting periods are set within a one-field period is described. Naturally, the distance between the start timings of adjacent light emitting periods is set shorter than a period length (25%) where a one-field period is equally divided into four periods.

Figure 34:
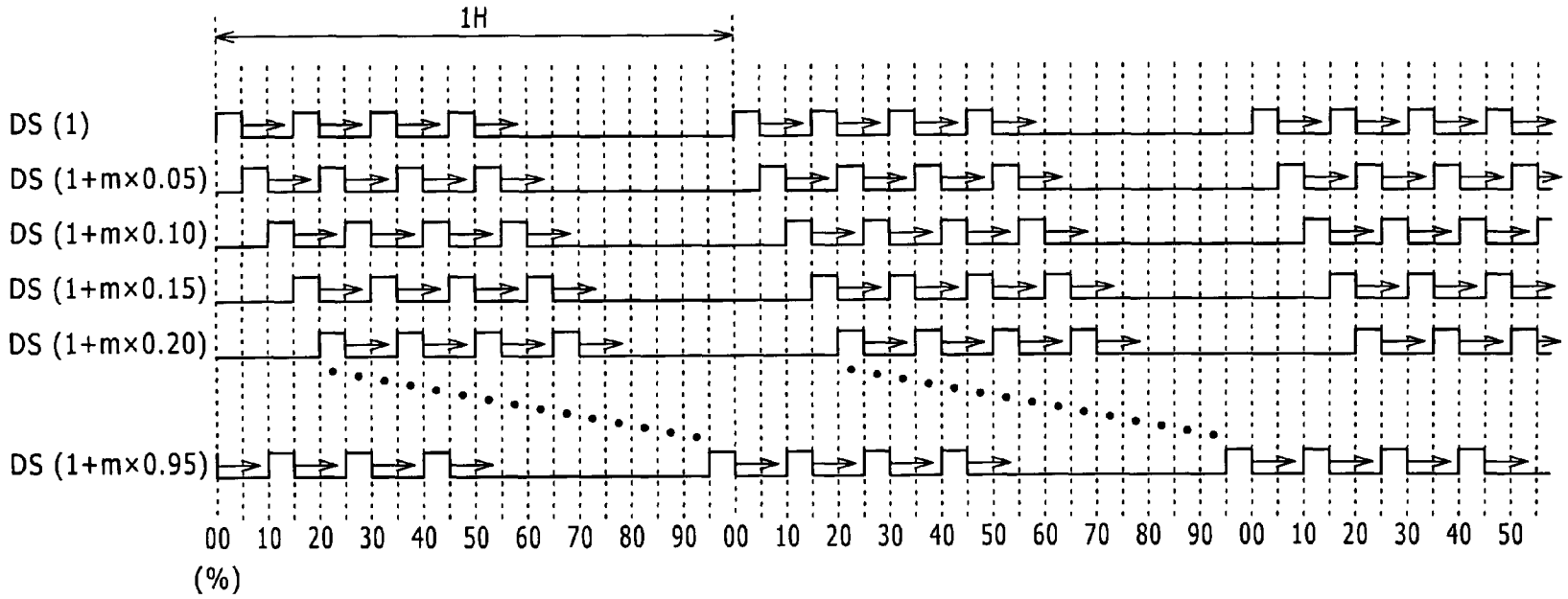
FIGS. 34 and 35 are timing charts illustrating different examples of driving timings of the organic EL panel of FIG. 17 according to a driving example 8.
Figure 35:
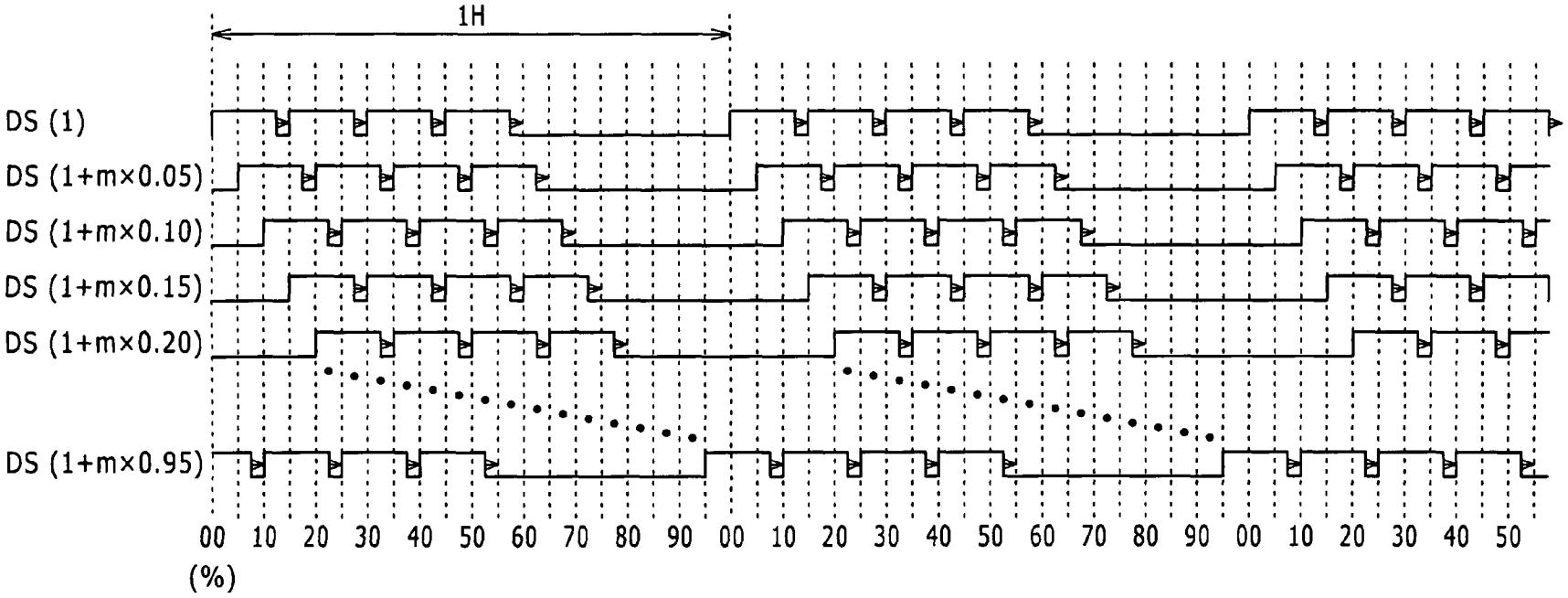

FIGS. 34 and 35 illustrate examples of driving timings of the second scanning line VSCAN2 where a one-field period includes four light emitting periods. In the examples of FIGS. 34 and 35, the distance between the start timings of adjacent light emitting periods is 15%. More particularly, the start timing of the first-time light emitting period is 0%; the start timing of the second-time light emitting period is 15%; the start timing of the third-time light emitting period is 30%; and the start timing of the fourth-time light emitting period is 45%.

It is to be noted that FIG. 34 illustrates an example of driving where the total light emitting period length (ratio DUTY) designated from the outside is comparatively short. Meanwhile, FIG. 35 illustrates an example of driving where the total light emitting period length (ratio DUTY) designated from the outside is comparatively long.

Also in the cases of FIGS. 34 and 35, the phase relationship makes one cycle with 20 lines similarly as in the driving examples described hereinabove, actually the phase relationship is set so as to make one cycle with M lines.

At this time, the light emitting timing determination section 23 determines the light emitting period corresponding to the sth scanning line VSCAN2($s$) in accordance with an expression given below.

However, also in the case of the calculation expression given below, it is assumed that a one-field period is given by m horizontal scanning periods. Also it is assumed that a writing operation into the sth scanning line VSCAN2($s$) is carried out within the sth horizontal scanning period and light emission is carried out simultaneously.

Further, the ratio of the light emitting period occupying in a one-field period T is represented by DUTY. It is to be noted that, if a result of the calculation does not become an integral value, then the corresponding timing is adjusted in a unit of a clock.

At this time, the light emitting period and the no-light emitting period are given by the following expressions:

where 0<DUTY<0.6,

First-Time Light Emitting Period:

$$[(s-1)/mJ\cdot T<t<\{[(s-1)/m]+\mathrm{DUTY}/4\}\cdot T$$

First-Time No-Light Emitting Period:

$$\{[(s-1)/m]+\mathrm{DUTY}/4\}\cdot T<t<\{[(s-1)/m]+0.15\}\cdot T$$

Second-Time Light Emitting Period:

$$\{[(s-1)/m]+0.15\}\cdot T<t<\{[(s-1)/mJ+0.15+\mathrm{DUTY}/4\}\cdot T$$

Second-Time No-Light Emitting Period:

$$\{[(s-1)/mJ+0.15+\mathrm{DUTY}/4\}\cdot T<t<\{[(s-1)/mJ+0.3\}\cdot T$$

Third-Time Light Emitting Period:

$$\{[(s-1)/mJ+0.3\}\cdot T<t<\{[(s-1)/mJ+0.3+\mathrm{DUTY}/4\}\cdot T$$

Third-Time No-Light Emitting Period:

$$\{[(s-1)/mJ+0.3+\mathrm{DUTY}/4\}\cdot T<t<\{[(s-1)/mJ+0.45\}\cdot T$$

Fourth-Time Light Emitting Period:

$$\{[(s-1)/m]+0.45\}\cdot T<t<\{[(s-1)/mJ+0.45+\mathrm{DUTY}/4\}\cdot T$$

Fourth-Time No-Light Emitting Period:

$$\{[(s-1)/mJ+0.45+\mathrm{DUTY}/4\}\cdot T<t<\{[(s-1)/mJ+1\}\cdot T$$

In the present driving example, the total light emitting period length (ratio DUTY) occupying in a one-field period T can be variably controlled within the range of 0% to 60%. Simultaneously, from the point of view of flickering and motion artifact, effects similar to those of the variation control based on the light emission period of 45% to 60% can be implemented.

In particular, in the present driving example, although the end timing of each of the light emitting periods is not fixed, since the distance between the start timings of adjacent light emitting periods is shorter than one fourth of the total light emitting period length the expansion of the movement width of the line of sight can positively be suppressed. Further, since the number of light emitting periods increases to four, even where the ratio DUTY of the light emitting period occupying in a one-field period T has a value proximate to zero, the light emission width on the visual sensation can be increased so that flickering can be perceived more readily.

In other words, deterioration of the picture quality by flickering and motion artifact can be minimized.

Further, the driving example 8 and the driving example 7 described hereinabove may be combined. In particular, four light emitting periods may be used only within part of a variation range such that, if this range is exceeded, then only one light emitting period is used for control.

D. Other Embodiments

D-1. Distance between the Start Timings of Adjacent Light

Emitting Periods

In the driving example 8 described above, the distances of the start timings of adjacent ones of light emitting periods are equal to each other (15%).

However, only some of the distances between the start timings between adjacent light emitting periods may be set as short as less than one over the number of light emitting periods within a one-field period. For example, in the case of the driving example 8, the distance between the start timings of the first- and second-time light emitting periods may be set to 15% while the distance between the start timings between the second- and third-light emitting periods and the distance between the start timings of the third- and fourth-light emitting periods are set to 25%.

Also in such a case as just described, the movement width of the line of sight can be suppressed when compared with an alternative case wherein a one-field period is equally divided by the number of light emitting periods. Consequently, a deterioration compensation effect of the picture quality involved in variation control of the peak luminance level can be expected. However, in order to avoid significant deterioration of the picture quality, preferably the variation range of the total light emitting period length is set so as to be included in the range from 25% to 75% of a one-field period.

D-2. Minimum Variation Unit of the Peak Luminance Level

In the driving example 6 described above, where the number of light emitting periods to be disposed in a one-field period is two, when the peak luminance level is varied by a minimum variation unit, the light emitting period length is controlled to increase or decrease by the minimum unit only for one of the two light emitting periods.

This driving method can be applied similarly also where the number of light emitting periods to be disposed in a one-field period is three or more. It is to be noted that, where the number of light emitting periods to be disposed in a one-field period is N, the number of those light emitting periods whose light emitting period length should be varied should be equal to or less than N−1. Naturally, as the number of N−1 decreases, the peak luminance level can be adjusted with increased smoothness.

In particular, most preferably the number of those light emitting periods whose light emitting period length should be varied with the minimum variation amount of the peak luminance level is only one from among the N light emitting periods. It is to be noted that the position of the light emitting period or periods whose light emitting period length should be varied is any number.

Product Examples a. Drive IC

In the foregoing description, a pixel array section and a driving circuit are formed on one panel.

However, it is possible to produce and distribute the pixel array section 3 and the driving sections 5, 7, 9, 23 or the like separately from each other. For example, it is possible to fabricate the driving sections 5, 7, 9, 23 or the like as an independent drive IC (integrated circuit) and distribute the same independently of a panel on which the pixel array section 3 is formed.

b. Display Module

Figure 36:
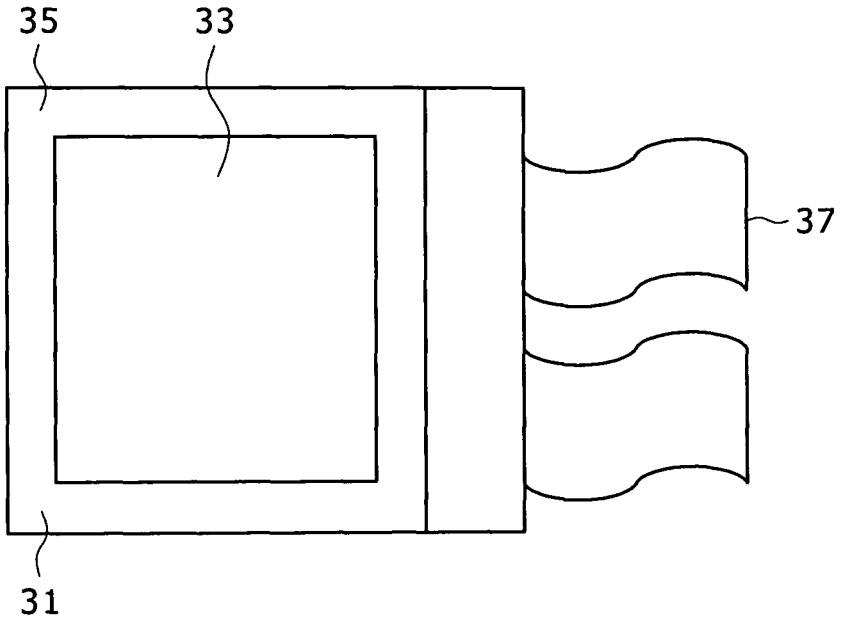
FIG. 36 is a schematic view showing an example of a configuration of a display module.

The organic EL panel 21 in the embodiment described above may be distributed in the form of a display module 31 having an appearance configuration shown in FIG. 36.

The display module 31 has a structure wherein an opposing section 33 adhered to the surface of a support board 35. The opposing section 33 includes a substrate formed from a transparent member of glass or the like and has a color filter, a protective film, a light blocking film and so forth disposed on the surface thereof.

It is to be noted that a flexible printed circuit (FPC) 37 for inputting and outputting a signal from the outside to the support board 35 and vice versa and other necessary elements may be provided on the display module 31.

c. Electronic Apparatus

The organic EL panel in the embodiments described hereinabove is circulated also in the form of a commodity wherein the organic EL panel is incorporated in an electronic apparatus.

Figure 37:
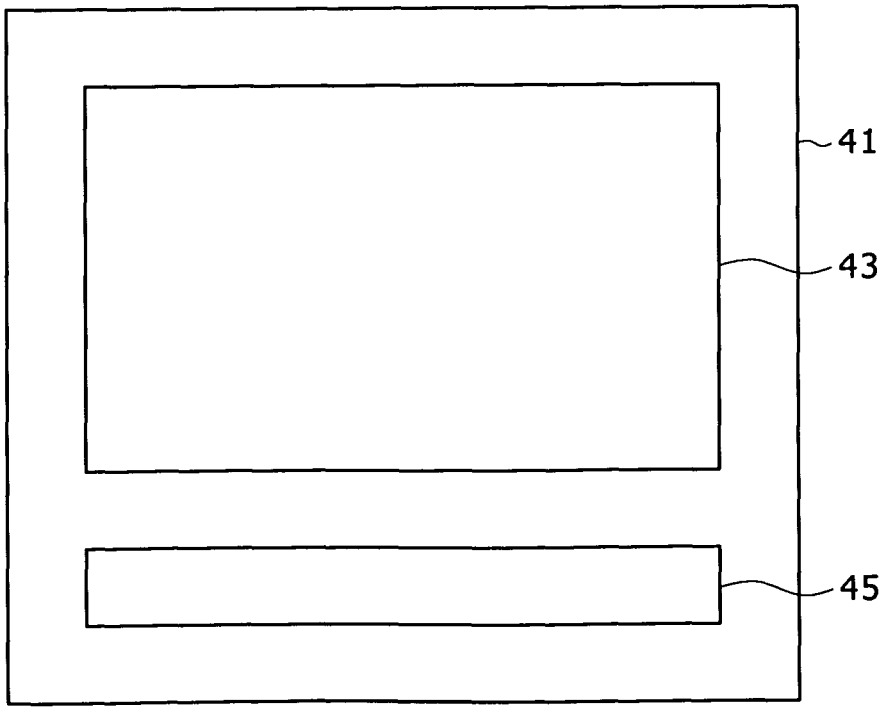
FIG. 37 is a schematic view showing an example of a function configuration of an electronic apparatus.

FIG. 37 shows an example of a configuration of an electronic apparatus 41. Referring to FIG. 37, the electronic apparatus 41 includes an organic EL panel 43, which may be any of the organic EL panels described hereinabove, and a system control block 45. The substance of processing executed by the system control block 45 depends upon the form of the commodity of the electronic apparatus 41.

It is to be noted that the electronic apparatus 41 is not restricted to apparatus of a particular field only if it incorporates a function of displaying an image produced in the electronic apparatus 41 or inputted from the outside.

Figure 38:
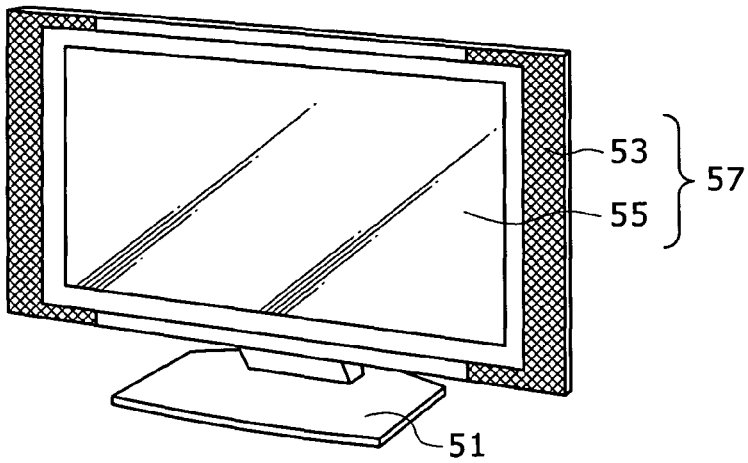
FIGS. 38, 39A and 39B, 40, 41A and 41B, and 42 are schematic views showing different examples of a commodity as an electronic apparatus.

The electronic apparatus 41 of the type described may be, for example, a television receiver. An example of an appearance of a television receiver 51 is shown in FIG. 38.

A display screen 57 formed from a front panel 53, a filter glass plate 55 and so forth is disposed on the front face of a housing of the television receiver 51. The display screen 57 corresponds to the organic EL panel described hereinabove in connection with the embodiment.

Figure 39A:
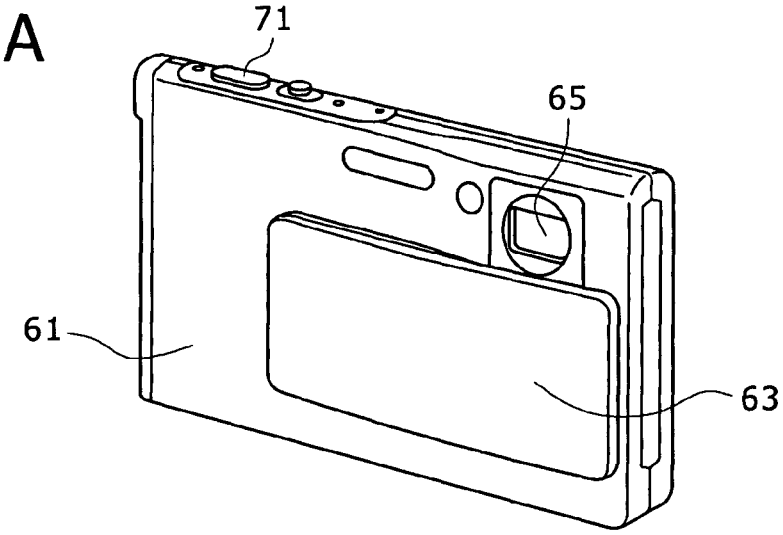
Figure 39B:
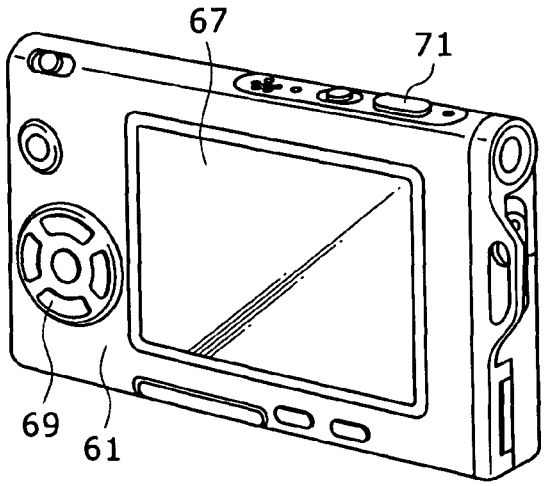

Or, the electronic apparatus 41 may be, for example, a digital camera. An example of an appearance of a digital camera 61 is shown in FIGS. 39A and 39B. FIG. 39A shows an example of an appearance of the digital camera 61 on the front face side, that is, on the image pickup object side, and FIG. 39B shows an example of an appearance of the digital camera 61 on the rear face side, that is, on the image pickup person side.

The digital camera 61 includes an image pickup lens not shown disposed on the rear face side of a protective cover 63 which is in a closed state in FIG. 39A. The digital camera 61 further includes a flash light emitting block 65, a display screen 67, a control switch 69 and a shutter button 71. The display screen 67 corresponds to the organic EL panel described hereinabove in connection with the embodiment.

Figure 40:
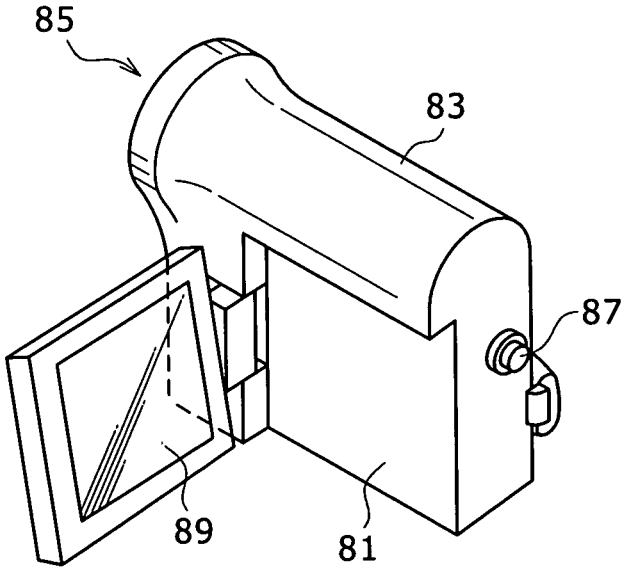

Or else, the electronic apparatus 41 may be, for example, a video camera. FIG. 40 shows an example of an appearance of a video camera 81.

Referring to FIG. 40, the video camera 81 shown includes an image pickup lens 85 provided at a front portion of a body 83 for picking up an image of an image pickup object, an image pickup start/stop switch 87, and a display screen 89. The display screen 89 corresponds to the organic EL panel described hereinabove in connection with the embodiment.

Figure 41A:
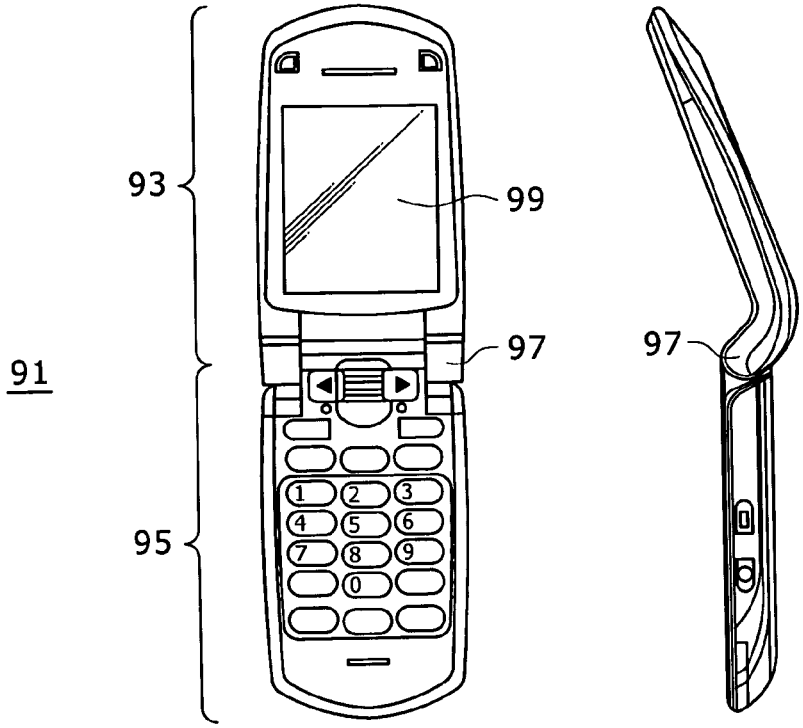
Figure 41B:
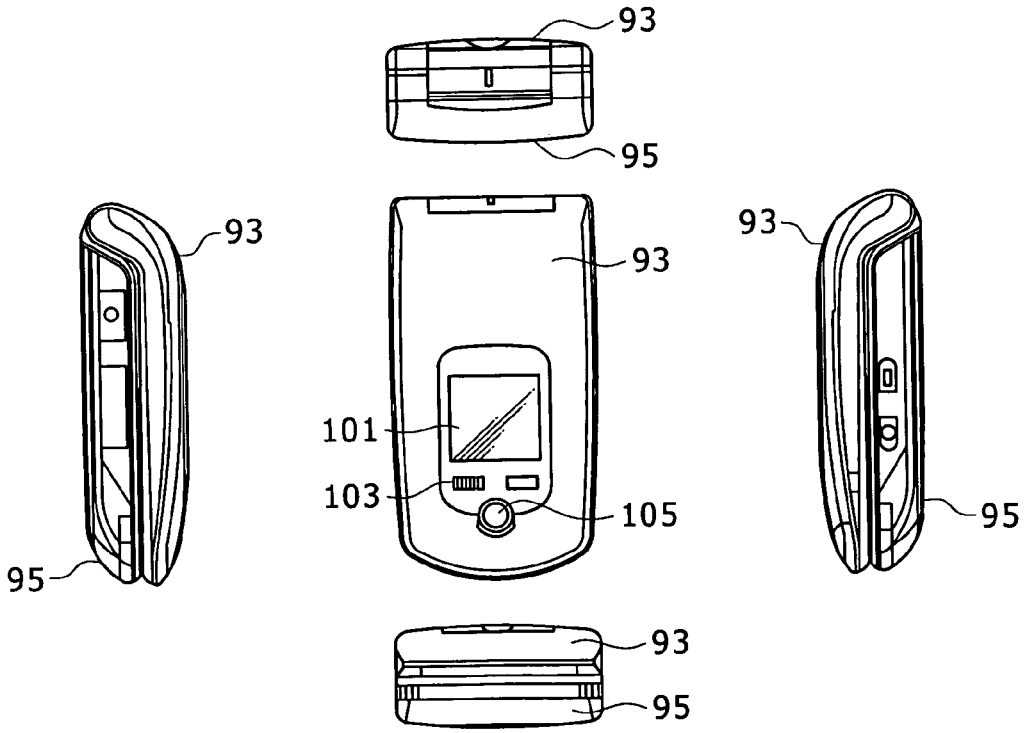

Or otherwise, the electronic apparatus 41 may be, for example, a portable terminal apparatus. FIGS. 41A and 41B show an example of an appearance of a portable telephone set 91 as a portable terminal apparatus. Referring to FIGS. 41A and 41B, the portable telephone set 91 shown is of the foldable type, and FIG. 41A shows the portable telephone set 91 in an unfolded state and FIG. 41B shows the portable telephone set 91 in a folded state.

The portable telephone set 91 includes an upper side housing 93, a lower side housing 95, a connection portion 97 in the form of a hinge, a display screen 99, an auxiliary display screen 101, a picture light 103 and an image pickup lens 105. The display screen 99 and the auxiliary display screen 101 correspond to the organic EL panel described hereinabove in connection with the embodiment.

Figure 42:
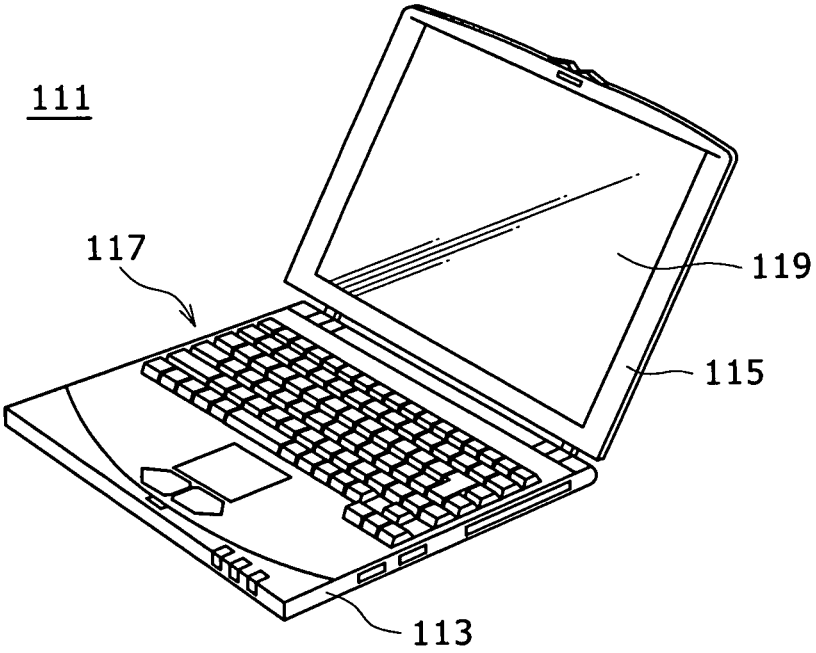

Furthermore, the electronic apparatus 41 may be, for example, a computer. FIG. 42 shows an example of an appearance of a notebook type computer 111.

The notebook type computer 111 includes a lower side housing 113, an upper side housing 115, a keyboard 117 and a display screen 119. The display screen 119 corresponds to the organic EL panel described hereinabove in connection with the embodiment.

The electronic apparatus 41 may further be formed as an audio reproduction apparatus, a game machine, an electronic book, an electronic dictionary or the like.

Other Examples of the Display Device

The driving methods described hereinabove may be applied also to other apparatus than organic EL panels. For example, the driving methods may be applied, for example, to inorganic EL panels, display panels on which LEDs (light emitting diode) are arrayed, plasma display panels and display panels of the self-luminous type wherein light emitting elements having other diode structures are arrayed on the surface.

Further, the driving methods described hereinabove may be applied also to display panels of the non-self-luminous type such as liquid crystal display panels.

While preferred embodiments of the present invention have been described using specific terms, such description is for illustrative purpose only, and it is to be understood that changes and variations may be made without departing from the spirit or scope of the following claims.

What is claimed is:

1. A display panel driving method of the type wherein the total light emitting period length within a one-field period is controlled to variably control the peak luminance level of a display panel, said display panel including a light emitting timing determination section and a supplemental scanning line driving section, comprising the step of:

variably controlling, where the one-field period has N light emitting periods per writing period, N being equal to or greater than 2, the end timing of the ith light emitting period and the start timing of the i+1th light emitting period so as to satisfy the total light emitting period length within the one-field period, i being an odd number which satisfies $1 \le i \le N-1$ while i+1 satisfies $2 \le i+1 \le N$, and supplying, by the light emitting timing determination section, a start pulse for providing a start timing of each light emitting period and an end pulse for providing an end timing of each light emitting period to the supplemental scanning line driving section, wherein said variably controlling further includes controlling the total light emitting period length to narrow a gap between the ith light emitting period and the i+1th light emitting period from the opposite directions, by adjusting both an end timing of the ith light emitting period and a start timing of the i+1th light emitting period.

2. The display panel driving method according to claim 1, wherein the period from the start timing of the first-time light emitting period to the end timing of the Nth-time light emitting period is equal to or longer than 25% but equal to or shorter than 75% of the one-field period.

3. The display panel driving method according to claim 1, wherein the start timing of the first-time light emitting period and the end timing of the Nth-time light emitting period are fixed.

4. The display panel diving method according to claim 1, wherein the end timing of the Nth-time light emitting period is variably controlled so as to satisfy the total light emitting period length.

5. The display panel driving method according to claim 1, wherein adjustment of the peak luminance level of the display panel is carried out by unit variation of the end timing of a certain one of the light emitting periods or by unit variation of the start timing of a certain one of the light emitting periods.

6. A display apparatus, comprising:

a display panel having a pixel structure ready for an active matrix driving method, a supplemental scanning line driving section, a display panel driving section configured to variably control the total light emitting period length within a one-field period to variably control the peak luminance level of said display panel, said display panel driving section variably controlling, where the one-field period has N light emitting periods per writing period, N being equal to or greater than 2, the end timing of the ith light emitting period and the start timing of the i+1th light emitting period so as to satisfy the total light emitting period length within the one-field period, i being an odd number which satisfies $1 \le i \le N-1$ while i+1 satisfies $2 \le i+1 \le N$, and a light emitting timing determination section configured to supply a start pulse for providing a start timing of each light emitting period and an end pulse for providing an end timing of each light emitting period to the supplemental scanning line driving section, the display panel driving section further variably controlling the total light emitting period length to narrow the gap between the ith light emitting period and the i+1th light emitting period from the opposite directions, by adjusting both an end timing of the ith light emitting period and a start timing of the i+1th light emitting period.

7. A display panel driving apparatus, comprising:

a display panel driving section configured to variably control the total light emitting period length within a one-field period to variably control the peak luminance level of a display panel, said display panel driving section variably controlling, where the one-field period has N light emitting periods per writing period, N being equal to or greater than 2, the end timing of the ith light emitting period and the start timing of the i+1th light emitting period so as to satisfy the total light emitting period length within the one-field period, i being an odd number which satisfies $1 \le i \le N-1$ while i+1 satisfies $2 \le i+1 \le N$, said display panel driving section further variably controls the total light emitting period length to narrow the gap between the ith light emitting period and the i+1 th light emitting period from the opposite directions, by adjusting both an end timing of the ith light emitting period and a start timing of the i+1th light emitting period.

8. An electronic apparatus, comprising:

a display panel having a pixel structure ready for an active matrix driving method, a supplemental scanning line driving section, a display panel driving section configured to variably control the total light emitting period length within a one-field period to variably control the peak luminance level of said display panel, said display panel driving section variably controlling, where the one-field period has N light emitting periods per writing period, N being equal to or greater than 2, the end timing of the ith light emitting period and the start timing of the i+1th light emitting period so as to satisfy the total light emitting period length within the one-field period, i being an odd number which satisfies $1 \le i \le N-1$ while i+1 satisfies $2 \le i+1 \le N$, a light emitting timing determination section configured to supply a start pulse for providing a start timing of each light emitting period and an end pulse for providing an end timing of each light emitting period to the supplemental scanning line driving section, and a system control section configured to control said display panel driving section and said display panel, wherein said display panel driving section variably controls the total light emitting period length to narrow a gap between the ith light emitting period and the i+1th light emitting period from the opposite directions, by adjusting both an end timing of the ith light emitting period and a start timing of the i+1th light emitting period.

9. An electronic apparatus, comprising:

a display panel having a pixel structure ready for an active matrix driving method, and a supplemental scanning line driving section;

a display panel driving section configured to control the total light emitting period length within a one-field period to variably control the peak luminance level of said display panel, said display panel driving section variably controlling, where the one-field period has N light emitting periods per writing period, N being equal to or greater than 2, such that at least one of distances between the start timings of adjacent ones of the light emitting periods is shorter than a period length obtained by dividing the one-field period into N periods;

a light emitting timing determination section configured to supply a start pulse for providing a start timing of each light emitting period and an end pulse for providing an end timing of each light emitting period to the supplemental scanning line driving section; and a system control section configured to control said display panel driving section and said display panel;

wherein said display panel driving section variably controls the total light emitting period length to narrow a gap between the ith light emitting period and the i+1th light emitting period from the opposite directions, by adjusting both an end timing of the ith light emitting period and a start timing of the i+1th light emitting period.

* * * * *